US009615643B2

(12) United States Patent
De Benedictis et al.

(10) Patent No.: US 9,615,643 B2
(45) **Date of Patent: *Apr. 11, 2017**

(54) HAIR STYLING DEVICE

(71) Applicants: Alfredo De Benedictis, Crumlin (GB); Janusz Lucien Holland, Birmingham (GB); Mark Christopher Hughes, Worcestershire (GB)

(72) Inventors: Alfredo De Benedictis, Crumlin (GB); Janusz Lucien Holland, Birmingham (GB); Mark Christopher Hughes, Worcestershire (GB)

(73) Assignee: TF3 LIMITED, Birmingham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/400,538

(22) PCT Filed: Jun. 11, 2013

(86) PCT No.: PCT/GB2013/051526

§ 371 (c)(1),
(2) Date: Nov. 11, 2014

(87) PCT Pub. No.: WO2013/186547

PCT Pub. Date: Dec. 19, 2013

(65) Prior Publication Data

US 2015/0128987 A1 May 14, 2015

(30) Foreign Application Priority Data

Jun. 11, 2012 (GB) ..... 1210274.5

(51) Int. Cl.
*A45D 2/36* (2006.01)
*A45D 2/02* (2006.01)
(Continued)

(52) U.S. Cl.
CPC ..... *A45D 2/367* (2013.01); *A45D 1/04* (2013.01); *A45D 1/06* (2013.01); *A45D 2/02* (2013.01); *A45D 6/02* (2013.01)

(58) Field of Classification Search
CPC ..... A45D 6/02; A45D 20/124; A45D 2/00; A45D 1/00; A45D 1/10; A45D 2002/005;
(Continued)

(56) References Cited

U.S. PATENT DOCUMENTS 1,636,967 A 7/1927 Perry
1,806,711 A 5/1931 Salzman
(Continued)

FOREIGN PATENT DOCUMENTS

EP 1417906 A1 5/2004
FR 641097 A 7/1928
(Continued)

OTHER PUBLICATIONS

Unpublished U.S. Appl. No. 14/490,736, filed Sep. 19, 2014.

*Primary Examiner* — Todd E Manahan
*Assistant Examiner* — Jennifer Gill
(74) *Attorney, Agent, or Firm* — Hultquist, PLLC; Steven J. Hultquist

(57) ABSTRACT

A hair styling device is disclosed. In one aspect the hair styling device includes: a body defining a chamber adapted to accommodate a length of hair, the chamber having a primary opening through which the length of hair may enter the chamber; a rotatable element adapted to engage the length of hair adjacent to the primary opening; an elongate member around which, in use, the length of hair is wound by the rotatable element; a guide part adapted to guide the length of hair towards the primary opening, the rotatable element being rotatable relative to the guide part, the guide part being movable relative to the body. The movable guide
(Continued)

part may also serve to press the length of hair towards the primary opening.

15 Claims, 19 Drawing Sheets

(51) Int. Cl.
*A45D 6/02* (2006.01)
*A45D 1/04* (2006.01)
*A45D 1/06* (2006.01)

(58) Field of Classification Search
CPC ..... A45D 2002/003; A45D 2002/006; A45D 2/10; A45D 7/02; A45D 6/00; A45D 1/20; A45D 1/04; A45D 1/047; A45D 2/36; A45D 2/362
USPC ..... 132/229, 231, 232, 237, 238–242, 132/223–225
See application file for complete search history.

(56) References Cited

U.S. PATENT DOCUMENTS 1,827,785 A 10/1931 Frederics
1,831,487 A 11/1931 Elam
1,884,305 A 10/1932 Shelton
1,894,624 A 1/1933 Marcel
1,895,653 A 1/1933 Fisher
1,981,362 A 11/1934 Joyce
2,791,225 A 5/1957 Simmons
2,867,223 A 1/1959 Anzalone
2,935,070 A 5/1960 Auz
3,213,859 A 10/1965 Mizell et al.
3,213,860 A * 10/1965 Tewksbury ..... A45D 6/06 132/228
3,223,093 A 12/1965 Winters
3,255,765 A 6/1966 Sturdivant
3,786,819 A 1/1974 Cantrell
3,805,810 A 4/1974 Savala
3,835,292 A 9/1974 Walter et al.
3,968,805 A 7/1976 Sobeck, Jr.
4,148,330 A 4/1979 Gnaga
4,177,824 A 12/1979 Gnaga
4,222,398 A 9/1980 Fromman
4,829,156 A 5/1989 Thompson
4,884,583 A 12/1989 Long, Jr.
5,119,847 A 6/1992 Powell et al.
5,472,003 A 12/1995 Frame et al.
5,584,309 A 12/1996 De Beneditis et al.
5,771,906 A 6/1998 De Benedictis
5,813,419 A 9/1998 Brams
6,637,441 B2 10/2003 Kennedy et al.
6,647,989 B1 11/2003 De Benedictis
6,962,159 B1 11/2005 Adam
7,121,285 B2 10/2006 Kraus
7,198,049 B2 4/2007 Elmer et al.
7,305,995 B2 12/2007 Tojo et al.
7,487,783 B2 2/2009 Saito et al.
7,500,487 B2 3/2009 Kobayashi et al.
7,513,259 B2 4/2009 Kimata et al.
7,770,586 B2 8/2010 Tojo et al.
7,789,093 B2 9/2010 Tojo et al.
8,132,575 B2 3/2012 Tojo et al.
8,256,438 B2 9/2012 Tojo et al.
8,607,804 B2 12/2013 De Benedictis
8,651,118 B2 * 2/2014 De Benedictis ..... A45D 2/02 132/238
8,733,374 B2 * 5/2014 De Benedictis ..... A45D 2/02 132/238
2004/0231689 A1 11/2004 Kobayashi et al.
2004/0231690 A1 11/2004 De Benedictis
2004/0237991 A1 12/2004 Glucksman et al.
2005/0241663 A1 11/2005 Getahun
2005/0268933 A1 12/2005 Kimata et al.
2005/0284493 A1 12/2005 Allen
2006/0124148 A1 6/2006 Tojo et al.
2006/0157078 A1 7/2006 Tojo et al.
2007/0017541 A1 1/2007 Wilmore
2007/0065489 A1 3/2007 Tojo et al.
2007/0068547 A1 3/2007 Gurth et al.
2007/0084479 A1 4/2007 Ryan-Jakimas
2008/0035167 A1 2/2008 Chan
2008/0236610 A1 10/2008 Bartels
2008/0302381 A1 12/2008 Tojo et al.
2009/0056738 A1 3/2009 Tojo et al.
2010/0083978 A1 4/2010 Hottenrott et al.
2010/0170883 A1 7/2010 Legrain et al.
2010/0263684 A1 * 10/2010 De Benedictis ..... A45D 2/02 132/272
2011/0220141 A1 9/2011 Chan
2012/0186601 A1 7/2012 Ungar et al.
2013/0025621 A1 1/2013 De Benedictis
2013/0125919 A1 * 5/2013 De Benedictis ..... A45D 2/02 132/238
2014/0076351 A1 3/2014 De Benedictis et al.
2014/0216494 A1 8/2014 De Benedictis et al.

FOREIGN PATENT DOCUMENTS

FR 38041 A 3/1931
GB 1036583 A 7/1966
GB 1157814 A 7/1969
GB 302952 A 12/1978
GB 2413492 A 11/2005
JP 61-10102 U 1/1986
JP 2005324073 A 11/2005
WO 0008967 A1 2/2000
WO 2005082198 A1 9/2005
WO 2008132345 A2 11/2008
WO 2009077747 A2 6/2009

* cited by examiner

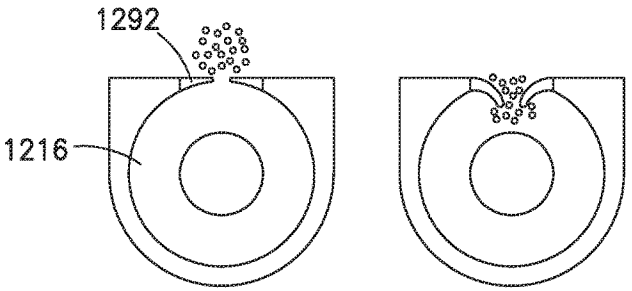
FIG.49
FIG.50
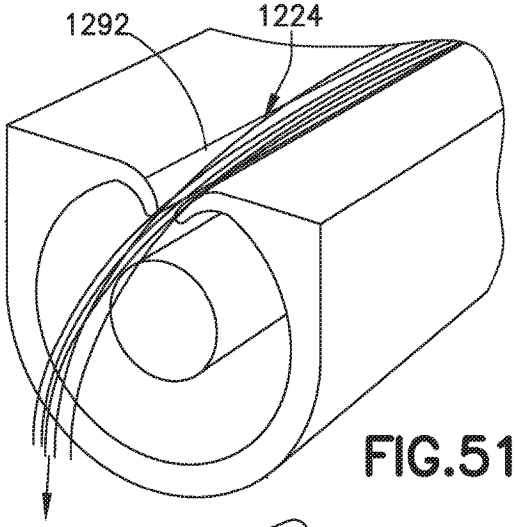
FIG.51
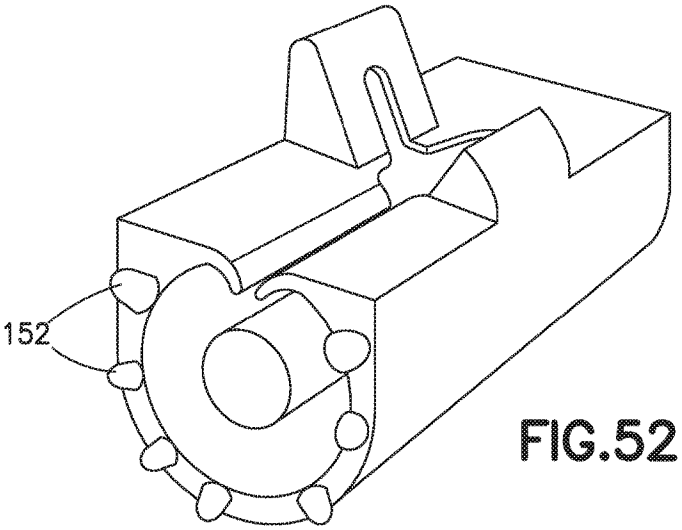
FIG.52
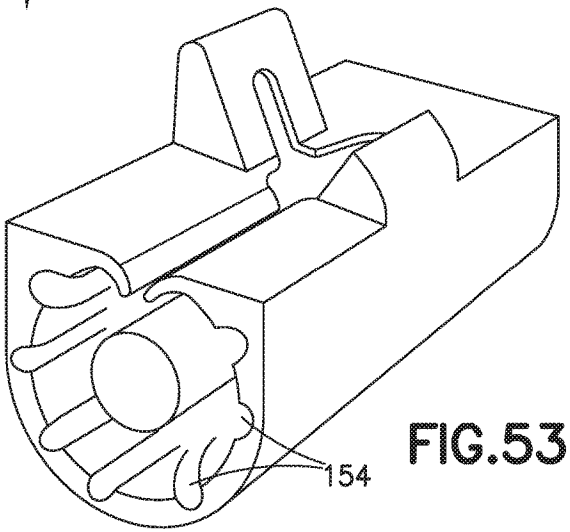
FIG.53

HAIR STYLING DEVICE

CROSS-REFERENCE TO RELATED APPLICATIONS

This application is a U.S. national phase under the provisions of 35 U.S.C. §371 of International Patent Application No. PCT/GB13/51526 filed Jun. 11, 2013, which in turn claims priority of United Kingdom Patent Application No. 1210274.5 filed Jun. 11, 2012. The disclosures of such international patent application and United Kingdom priority patent application are hereby incorporated herein by reference in their respective entireties, for all purposes.

FIELD OF THE INVENTION

This invention relates to a hair styling device, and in particular to an improvement upon the hair styling devices disclosed in our earlier applications WO2009/077747 and WO2012/080751.

For brevity, in the present application reference is made to the styling of a female's hair, but the invention is not limited thereby.

BACKGROUND TO THE INVENTION

The hair styling devices described in WO2009/077747 and WO2012/080751 have a rotatable element which captures or collects a length of hair to be styled, and winds the length of hair around an elongate member. The preferred embodiments utilise a chamber surrounding the elongate member, the chamber being heated by way of heat applied to the walls of the chamber and/or to the elongate member. The hair within the chamber becomes styled by the application of heat whilst it is located around the elongate member.

The present invention shares many of the features of the preferred embodiments of the hair styling device described in WO2009/077747 and WO2012/080751, and so the disclosure of those documents is incorporated herein in order to avoid unnecessary repetition.

In addition, it is believed that the hair styling devices described in WO2009/077747 and WO2012/080751 represent the closest prior art to the present invention. Less relevant hair styling devices are described in U.S. Pat. Nos. 2,935,070 and 4,177,824.

SUMMARY OF THE INVENTION

Notwithstanding the practical and commercial attractiveness of the hair styling devices described in WO2009/077747 and WO2012/080751, the present inventors have conceived further improvements and modifications, and the present invention is directed to those improvements and modifications.

According to a first aspect of the present invention, there is provided a hair styling device having:

a body defining a chamber adapted to accommodate a length of hair, the chamber having a primary opening through which the length of hair may pass into the chamber;

a rotatable element adapted to engage the length of hair adjacent to the primary opening;

an elongate member around which, in use, the length of hair is wound by the rotatable element;

a movable panel having an open position in which the primary opening is open to receive the length of hair, and a closed position in which the primary opening is covered, the movable panel having heating means.

Movable panels which can cover the primary opening are disclosed in WO2009/077747 and WO2012/080751, but those movable panels are not heated.

The inventors have realised that it is advantageous to increase the width of the primary opening. In the preferred embodiments of WO2009/077747 and WO2012/080751 the primary opening is relatively narrow. The primary opening therefore represents a narrow "throat" through which the hair must pass in order to enter the chamber. This is advantageous in terms of encouraging the user to impart curls to small sections of hair at a time. However, the inventors have realised that a wider primary opening can enable the user to place the length of hair closer to the elongate member, which in turn allows the rotatable element to have a smaller diameter, whereby the overall size of the device can be reduced. However, a wider primary opening reduces the area of the wall of the chamber which can be heated.

It is preferable to heat the chamber by way of the outer wall of the chamber (and perhaps also the elongate member), the area of the outer wall enabling a rapid transfer of heat to the hair within the chamber whilst avoiding very high temperatures which might damage the user's hair. Heating at least part of the panel which covers the primary opening maximises the heat which can be applied, or otherwise stated avoids a large proportion of the outer wall of the closed chamber being unheated.

Desirably, the movable panel in its closed position covers the rotatable element as well as the primary opening.

Preferably, the primary opening is at least as wide as the width of the elongate member. Desirably, at least a part of the elongate member lies within the primary opening. In the preferred embodiments of WO2009/077747 and WO2012/080751, the primary opening is located some distance from the longitudinal axis of the elongate member, and in particular much further from the longitudinal axis than the periphery of the elongate member. Making the primary opening wider, and locating the primary opening closer to the longitudinal axis, allows the user to place the length of hair closer to the elongate member, and perhaps into engagement with the elongate member, before actuating the rotatable element. The circular path which is swept by the rotatable element can therefore be reduced in diameter, with the advantage that the whole device can be reduced in size.

A wider primary opening has additional benefits. Firstly, the user is required to be less accurate in positioning the length of hair adjacent to the primary opening, which may be beneficial when the user is unsighted (such as styling the hair at the back of her head for example). Secondly, whilst the hair is not clamped or intentionally placed under tension during the styling procedure, a force is required to move the hair through the primary opening. If the user inadvertently seeks to curl a section of hair which is too thick to pass through the primary opening, the force which would be required to pass the length of hair through the primary opening can be significant. Whilst it can be arranged that the rotatable element will stall rather than damage the user's hair, it is preferable to avoid unintentional tension upon the user's hair. The provision of a wider primary opening can reduce the force required to move the hair into the chamber, even if the user seeks to curl a thick section of hair.

In alternative embodiments of the device the walls of the chamber may not be heated, in which case the movable panel does not need to be heated either. These embodiments may heat the hair by external means such as a hair dryer for example. These alternative embodiments may nevertheless benefit from the provision of a wider primary opening in terms of a reduced dimension rotatable element.

In common with the disclosure of WO2012/080751, a secondary opening preferably surrounds the free end of the elongate member. The elongate member may project beyond the secondary opening, or it may terminate in line with the secondary opening, or it may terminate within the chamber. The term "surrounds" is used for all of these alternatives because the relevant feature is that the secondary opening permits a formed curl to slide off the end of the elongate member without being forced to uncurl or deform. The term "surrounds" should therefore be considered from a viewpoint looking along the axis of the elongate member. This feature distinguishes the first aspect of the invention from the device of FIGS. 13 and 14 of WO2009/077747 for example, in which device the secondary opening through which the curled hair is removed lies only to one side of the elongate member.

As stated in WO2012/080751, the avoidance of a requirement to force a wound curl to unwind as it is removed from the hair styling device has significant benefits in terms of the hair styling. Thus, since the chamber and therefore the hair is still hot as it is pulled out of the chamber, the hair continues to be styled as it is removed from the chamber, and a significant proportion (perhaps around 25% for example) of the curvature of a wound curl can be lost as the length of hair is pulled out of the chamber, despite the hair being subjected to only a small force during such removal.

According to a second aspect of the present invention, there is provided a hair styling device having:

a body defining a chamber adapted to accommodate a length of hair, the chamber having a primary opening through which the length of hair may enter the chamber;

a rotatable element adapted to engage the length of hair adjacent to the primary opening;

an elongate member around which, in use, the length of hair is wound by the rotatable element;

a guide part adapted to guide the length of hair towards the primary opening, the rotatable element being rotatable relative to the guide part, the guide part being movable relative to the body.

Guide means for guiding the length of hair towards the primary opening are described in WO2009/077747 and WO2012/080751. In embodiments shown in those documents the guide means comprise inclined surfaces which converge towards the primary opening. The provision of a movable guide part enables a reduction in size of the hair styling device, particularly in those embodiments having a movable panel which covers the guide part.

Preferably, the guide part also acts to press the length of hair towards the primary opening in use. Desirably, the hair styling aid has a panel which is movable relative to the primary opening, the guide part being movable relative to the panel.

A pressing part which acts to press a portion of the length of hair towards the primary opening is described in WO2012/080751, the pressing part being integral with a movable panel. Having the pressing part integral with the movable panel results in a simple construction with few moving parts. However, having the pressing part movable relative to the panel allows the pressing part to act also as the guide means.

Preferably, the guide part blocks the gap between the body and the movable panel when the panel is in its open position.

Desirably, the movable panel can cover the rotatable element. Even in those embodiments in which the guide part is not carried by the movable panel it is desirable to provide a movable panel to cover the rotatable element in use so as to avoid the rotatable element capturing stray hair (on its second or third rotation, for example), which would likely result in entanglement of the user's hair.

Preferably, the movable panel covers the guide part as well as the rotatable element.

Desirably, the device has two guide parts, the guide parts being spaced apart along the length of the primary opening. Desirably also, the device includes at least one inclined surface located adjacent to the primary opening, the respective guide parts passing to opposed sides of the inclined surface(s). In this way, the guide parts can also act as pressing parts and drive the length of hair across the inclined surface(s) towards the primary opening, to better ensure that all of the hair is engaged and collected by the rotatable element. There may be two inclined surfaces, for example, the inclined surfaces converging towards the primary opening.

According to a third aspect of the present invention, there is provided a hair styling device having:

a body defining a chamber adapted to accommodate a length of hair, the chamber having a primary opening through which the length of hair may pass;

a rotatable element adapted to engage the length of hair adjacent to the primary opening;

an elongate member around which, in use, the length of hair is wound by the rotatable element;

two movable cover elements for the rotatable element, the movable cover elements having an open position in which the rotatable element is exposed, and a closed position in which the rotatable element is covered by the movable cover elements, the movable cover elements having respective leading edges which act to press a length of hair towards the primary opening as they move from their open position to their closed position.

Preferably, the movable cover elements move towards one another as they move from their open position to their closed position. Desirably, in the closed position a part of one of the movable cover elements lies underneath the other cover element.

In their closed position, the cover elements enclose the rotatable element and act to prevent the rotatable element from engaging stray hair. The cover elements can replicate a "scissor" action, and the location of a part of one of the movable cover elements within the other cover element, enables the cover elements to fully enclose the rotatable element as it rotates.

Desirably, the movable cover elements are pivotably mounted upon the body. Preferably, the pivot axes are substantially parallel with the rotational axis of the rotatable element.

According to a fourth aspect of the present invention, there is provided a hair styling device having:

a body defining a chamber adapted to accommodate a length of hair, the chamber having a primary opening through which the length of hair may pass;

a rotatable element adapted to engage the length of hair adjacent to the primary opening, the rotatable element extending beyond the chamber;

an elongate member around which, in use, the length of hair is wound by the rotatable element;

the body being formed from two body parts which are hinged to one another.

The invention according to this aspect therefore shares the feature of the preferred embodiments of WO2009/077747, and the embodiments of WO2012/080751, in having a rotatable element which extends (laterally) beyond the chamber (see for example the embodiment of FIGS. 1-8 of WO2009/077747).

Preferably, each body part includes a groove to accommodate the rotatable element. Preferably also, each body part has a first wall part which is substantially semi-circular, whereby the body parts when moved to their closed position provide the chamber having a substantially circular outer wall.

Desirably, each body part has a flange. In the open condition of the body parts the space between the flanges provides the primary opening, and the flanges provide inclined surfaces to guide a length of hair towards the primary opening. In the closed condition of the body parts the flanges engage one another to close the primary opening and cover the rotatable element.

Preferably, the body parts are substantial mirror images of each other.

According to a fifth aspect of the present invention, there is provided a hair styling device having:

a body defining a chamber adapted to accommodate a length of hair, the chamber having a primary opening through which the length of hair may pass;

a rotatable element adapted to engage the length of hair adjacent to the primary opening;

an elongate member around which, in use, the length of hair is wound by the rotatable element;

the rotatable element having a first part and a second part, the first part and second part being movable relative to one another, the first and second parts having an open condition in which they define an open-ended aperture adapted to capture a length of hair, and a closed position in which the aperture is substantially closed.

It will be understood that when the first and second parts are in their closed condition the likelihood of stray hair being captured by the rotatable element is reduced or avoided. Such an arrangement may therefore be usable without a cover or panel for the rotatable element.

Preferably, the first part and the second part contra-rotate in order to move from their open position to their closed position, and also to capture the length of hair. The first and second parts then rotate together, in a chosen direction, in order to curl the length of hair around the elongate member. Alternatively, only the first part rotates to capture the length of hair, the second part being driven to rotate with the first part once the length of hair has been captured and the aperture has been closed.

According to a sixth aspect of the present invention, there is provided a hair styling device having:

a body defining a chamber adapted to accommodate a length of hair, the chamber having a primary opening through which the length of hair may pass;

a rotatable element having a leading edge which is adapted to engage the length of hair adjacent to the primary opening, the leading edge moving around a circular path;

an elongate member around which, in use, the length of hair is wound by the rotatable element;

a closure element for closing off the primary opening, the closure element being located at the diameter of the circular path.

The inventors have recognised that it is important for the rotatable element to capture all of the length of hair which is to be styled, and for the length of hair to be captured as the rotatable element passes the primary opening during its initial rotation. Entanglement is likely if some of the length of hair is not captured during the initial rotation of the rotatable element, or if stray hair is captured by the leading edge of the rotatable element during subsequent passes of the primary opening. Entanglement is likely in particular if the user actuates the device whilst the length of hair is located adjacent to the primary opening, with some of the hair within the circular path of the rotatable element and some of the hair outside the circular path. With embodiments of the hair styling device utilising smaller rotatable elements, the likelihood of the user failing to ensure that all of the length of hair lies within the circular path of the leading edge of the rotatable element is likely to increase.

Rather than use one or more combined guide and pressing parts as in certain aspects of the invention, the present aspect uses a closure element which is coincident with the circular path of the leading edge of the rotatable element, and which can therefore separate hair which lies adjacent to the primary opening into a first portion within the circular path (which first portion will be captured and moved into the chamber), and a second portion which is outside the circular path, and which second portion is therefore held away from the rotatable element.

Desirably, the closure element presses the respective portions of the length of hair away from the diameter of the circular path of the leading edge of the rotatable element, so that no hair lies precisely upon the diameter of the circular path. The respective portions of the length of hair are forced to positions within the circular path, or outside the circular path.

Preferably, the closure element is bifurcated and has a part lying to either side of the rotatable element.

Many features of each aspect of the invention may be combined with features of other aspects of the invention with which they are compatible, as desired. In all aspects, the present invention shares the benefits of WO2009/077747 in not clamping any part of the length of hair in use, and in not applying tension to the length of hair during the styling process.

BRIEF DESCRIPTION OF THE DRAWINGS

The invention will now be described in more detail, by way of example, with reference to the accompanying drawings, in which:

FIG. 49 shows the optional flexible doors which may be incorporated into the hair styling device, in the closed position;

FIG. 50 shows the doors of FIG. 49 in the open position;

FIG. 51 shows a perspective view of part of a hair styling device having the optional flexible doors of FIG. 49;

FIG. 52 shows a perspective view of part of a hair styling device having projections to temporarily trap the length of hair;

FIG. 53 shows a perspective view of part of a hair styling device having indentations to temporarily trap the length of hair;

DETAILED DESCRIPTION OF THE INVENTION

Figure 1:
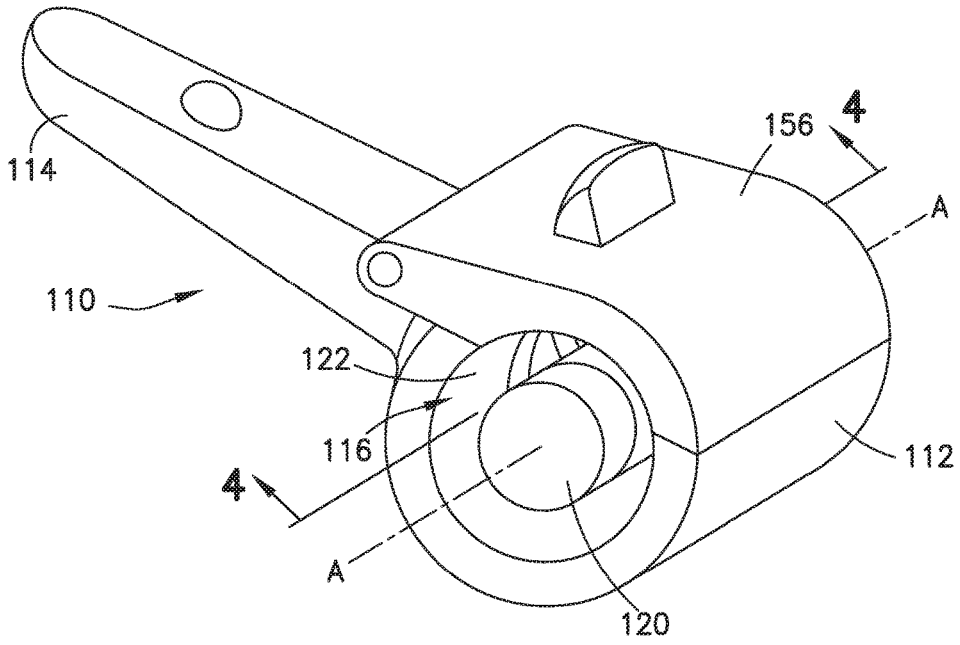
FIG. 1 shows a perspective view of a hair styling device according to the first aspect of the present invention, with the movable panel in the closed position.

Whilst WO2009/077747 is included herein by reference, a brief description of the operation of the device is provided in relation to the embodiment of FIGS. 1-5, so as to clarify the distinctions over the previous disclosure.

The hair styling device 110 has a body 112 and a handle 114. Within the body 112 is a chamber 116. An elongate member 120 is located within the chamber 116, the diameter 2r of the elongate member 120, and the diameter D of the wall 122 of the chamber (see FIG. 5), being chosen to produce curls of the desired curvature. (It will be understood that the elongate member 120, and the chamber 116, need not be of circular cross-section, and so the reference to "diameter" refers only to those circular embodiments).

The body 112 has a primary opening 124 (FIG. 2) through which a length of hair 126 (FIGS. 3,4) may be introduced into the chamber 116. In this embodiment, the introduction of a length of hair 126 into the device is facilitated by a pair of inclined surfaces 130 and 132, which lie to opposed sides of the primary opening 124. It will be understood that in other embodiments one or both of the inclined surfaces is omitted.

Figure 2:
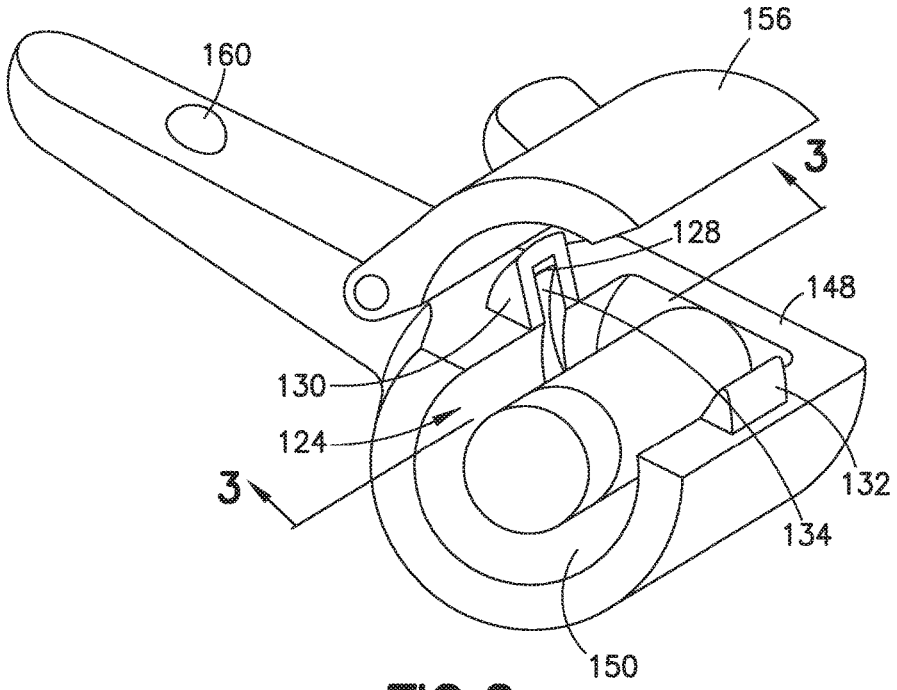
FIG. 2 shows the hair styling device of FIG. 1, with the movable panel in the open position.
Figure 47:
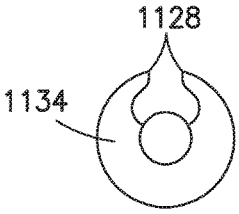
FIG. 47 shows the rotatable element of the embodiment of FIG. 44.
Figure 48:
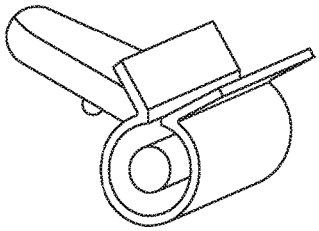
FIG. 48 shows a perspective view of the embodiment of FIG. 44.

The device 110 has a rotatable element 134 (which may be identical to the rotatable element 1134 which is better shown in the embodiment of FIG. 47) which can be driven to rotate about a longitudinal axis A-A. The rotatable element 134 projects beyond the primary opening 124, and as seen in FIG. 2 the inclined surfaces 130 and 132 have cut-outs formed therein to accommodate the rotatable element 134 during its rotation.

In this embodiment the axis A-A around which the rotatable element 134 rotates is parallel to and coincident with the longitudinal axis of the elongate member 120, but that is not necessarily the case. Also, in this embodiment the elongate member 120 is fixed relative to the body 112, i.e. it does not rotate with the rotatable element 134, but that is also not necessarily the case, and in other embodiments the elongate member rotates with the rotatable element.

As the rotatable element 134 rotates (clockwise as drawn in FIG. 1), its leading edge 128 passes over the length of hair 126 which lies adjacent to the primary opening 124, and its leading edge 128 captures the length of hair 126. The form of the rotatable element 134 is such that it pulls the length of hair 126 through the primary opening 124 and into the chamber 116 as it rotates.

Figure 3:
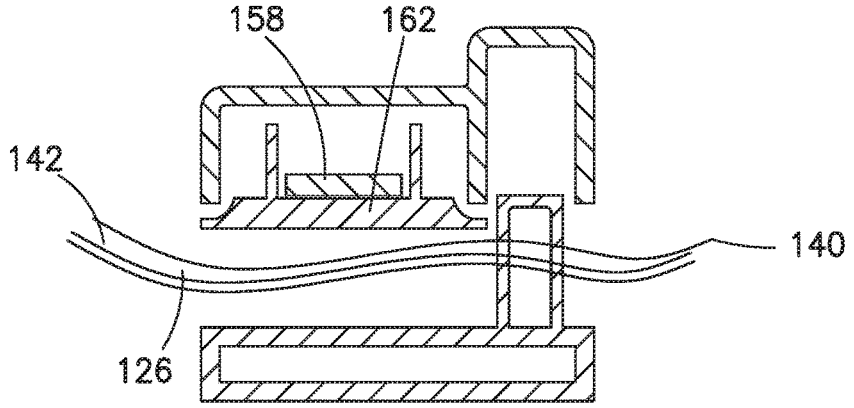
FIG. 3 shows a sectional view of the hair styling device of FIG. 1, with the movable panel in the open position.

Considering the length of hair 126 shown in FIG. 3, the end 140 is the free end of the length of hair, and the part 142 is connected to the user's head (not shown). The hair styling device 110 is intended to impart curls to substantially all of the length of hair 126 lying between the part 142 and the free end 140, so that the numeral 142 represents the "end" of the length of hair 126 which will be styled by the device. Each of the individual hairs in the length of hair 126 will be connected to the user's scalp (not shown).

As the rotatable element 134 rotates, the distal portion of the length of hair 126 (which lies between the rotatable element 134 and the free end 140), is pulled through the primary opening 124 to the far side of the rotatable element as drawn in FIG. 2. As shown in FIG. 2, the primary opening 124 has a closed end 148 which provides a relatively fixed surface and it is the relative rotation between the rotatable element 134 and the primary opening 124 (and in particular its closed end 148) which causes the hair to be drawn into the device 110.

In this embodiment, the primary opening 124 is connected to a secondary opening 150. When the rotatable element 134 is rotated, the proximal portion of the length of hair (which lies between the rotatable element 134 and the part 142), will also be pulled through the primary opening 124 and into the chamber 116, to the near side of the rotatable element as viewed in FIG. 2. In particular, the proximal portion is pulled through the primary opening 124 and into the secondary opening 150.

Though not shown in the drawings, the hair styling device 110 can include an abutment within the secondary opening 150 which provides a relatively fixed surface, and it will be understood that it is the rotation of the rotatable element 134 relative to the fixed abutment which causes the length of hair to be drawn into the chamber 116.

In other embodiments, the user is instructed to place a finger or thumb across the secondary opening 150, the user's finger or thumb providing the abutment. In yet other embodiments, the secondary opening carries a number of projections 152 such as those shown in FIG. 52, or a number of indentations 154 as in the embodiment of FIG. 53, and the user can manipulate the hair styling device so as to temporarily trap the length of hair between projections 152 or within indentations 154.

It is understood that the abutment may not need to remain in position for the whole of the styling procedure, and in some cases once the length of hair begins to be wound around the elongate member 120 the abutment (such as the user's finger or thumb for example) can be removed whilst the rotatable element continues to rotate.

In common with the hair styling devices of WO2009/077747, the hair is not clamped by any part of the device 110. The part 142 of the length of hair 126 is, however, substantially fixed in position relative to the device 110. Accordingly, as the rotatable element 134 continues to rotate, the distal portion of the length of hair 126 is gradually pulled from the far side of the rotatable element 134 to the near side, as drawn in FIG. 2, until eventually all of the length of hair 126 is wound around the elongate member 120 to the near side of the rotatable element 134.

The chamber 116 is heated, in this embodiment by way of heating elements (not shown) within the elongate member 120 and within the wall 122 of the chamber 116.

The movable panel 156 is pivotably mounted upon the handle 114, the pivot axis being relatively close to the chamber 116 (and substantially closer to the chamber 116 than the pivot axis of the movable panel of WO2012/080751) and in this embodiment is electrically actuated by way of a switch 160. The switch may be located at any suitable location upon the handle 114. In the alternative embodiment of FIGS. 6-11 the movable panel is manually actuated by way of a trigger 260 and such a method may be used as an alternative to electrical actuation.

Figure 4:
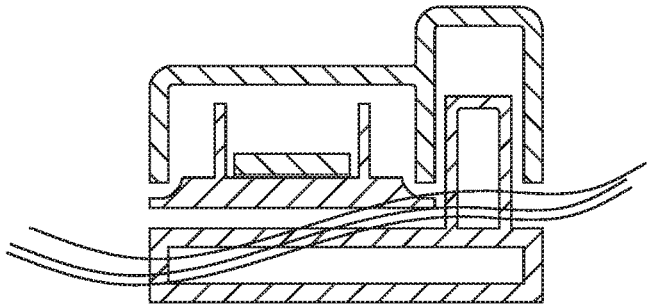
FIG. 4 shows a sectional view as FIG. 3, but with the movable panel in the closed position.

The movable panel 156 can be moved relative to the body 112 between the open position shown in FIGS. 2 and 3 and the closed position shown in FIGS. 1 and 4. In this embodiment the movable panel 156 is electrically actuated to move between its open and closed positions, but in other embodiments the panel may be resiliently biased to one of these positions.

The hair styling device 110 is therefore particularly suited for use by a person styling her own hair, the user grasping the length of hair 126 with one hand and grasping (and operating) the hair styling device 110 with the other hand. The ability to grasp and manipulate the hair styling device 110 with one hand will also be advantageous for hairdressers and the like when using the device to style another person's hair.

Figure 5:
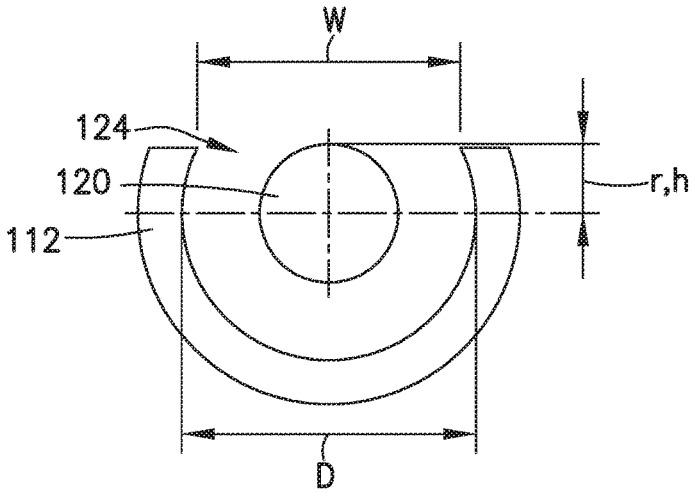
FIG. 5 shows an end view of part of the device of FIG. 1.
Figure 6:
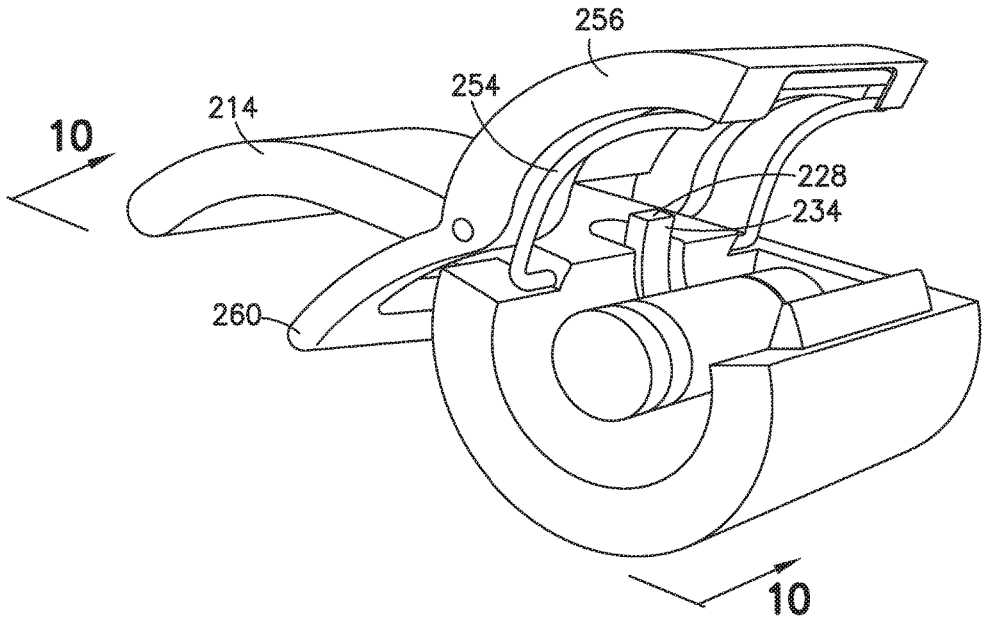
FIG. 6 shows a perspective view of a hair styling device according to the second aspect of the invention, with the guide part and movable panel in the open position.
Figure 7:
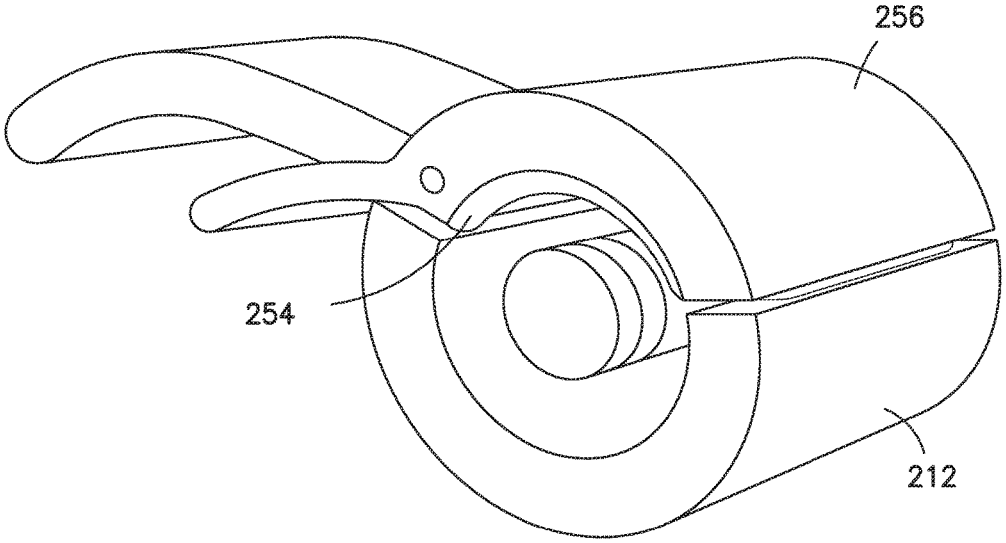
FIG. 7 shows a perspective view as FIG. 6, but in the closed position.
Figure 9:
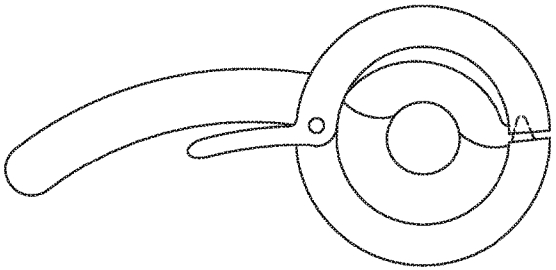
FIG. 9 shows a side view as FIG. 7.
Figure 11:
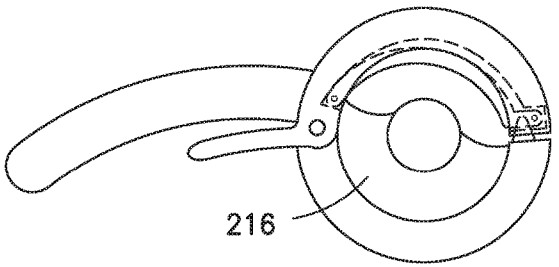
FIG. 11 shows a view as FIG. 10, in the closed position.

As is made clear from FIG. 5, the width W of the primary opening 124 is significantly larger than the primary opening of the comparable embodiment of FIGS. 1-8 of WO2009/077747 and of the embodiment of FIGS. 1-5 of WO2012/080751.

In particular, the width W of the primary opening 124 is substantially wider than the diameter 2r of the elongate member 120. In addition, the primary opening lies adjacent to the edge of the elongate member 120, i.e. the height h of the primary opening above the longitudinal axis A-A of the elongate member 120 is in this embodiment approximately the same as the radius r of the elongate member. The user is therefore able to place the length of hair 126 much closer to the elongate member 120 (and perhaps into engagement with the elongate member 120) prior to actuation of the rotatable element 134, with the advantage that the rotatable element 134 can be smaller, allowing a reduction in the overall size of the device 110, particularly in the cross-sectional dimension of the body 112.

It will be understood that the height h of the primary opening 124 above the longitudinal axis A-A of the rotatable element can in other embodiments be less than, or greater than, the radius r of the elongate member. Also, the width W of the primary opening 124 can be reduced from that shown in FIG. 5, to approximately the same as the width 2r of the elongate member.

Because the primary opening 124 spans a large proportion of the circumferential length of the wall of the chamber 116, the panel 156 is heated by way of a heater element 158 mounted in engagement with the heat-conductive wall 162 of the panel 156. In the closed position of the panel heat can therefore be applied to the length of hair within the chamber 116 around substantially the full circumference of the chamber 116 (and along substantially the full length of the chamber 116).

In the embodiment of FIGS. 1-5 the movable panel 156 provides the dual function of covering the rotatable element 134 and closing the primary opening 124. The movable panel 156 spans the full length of the chamber 116 so that the maximum quantity of heat can be delivered into the chamber. It will be understood that in embodiments according to other aspects of the invention (in which the movable panel is not heated for example) it is not necessary that the panel spans the full length of the chamber.

When the length of hair 126 has been styled, for example by remaining within the heated chamber 116 for a predetermined length of time, the curled length of hair 126 can be slid off the end of the elongate member 120, through the secondary opening 150 (the abutment within the secondary opening being moved if necessary). Little force is required to separate the hair styling device 110 from the length of hair which has been styled, and because the secondary opening 150 surrounds the elongate member 120 the length of hair is not required to pass any obstruction or otherwise be forced to uncurl during its removal from the hair styling device 110, so that the curvature of the curls created by the device can be substantially maintained.

It has been recognised that the most significant likelihood of entanglement of the length of hair 126 is caused by a portion of the length of hair 126 being captured by the rotatable element, and another portion of the length of hair 126 not being captured by the rotatable element. In such circumstances the captured portion becomes wound around the elongate member whereas the uncaptured portion does not. Embodiments of the present invention which seek to reduce the likelihood of such entanglement by increasing the likelihood that all of the length of hair 126 is captured by the rotatable element are shown in FIGS. 6-11, FIGS. 12-15, FIGS. 16-18, FIGS. 19-20, FIGS. 21-28, FIGS. 29-33 and FIGS. 54-49.

In addition to the optional inclusion of fixed inclined surfaces which serve to guide the length of hair towards the primary opening, these drawings show various embodiments of a movable guide part 254 (etc.) which serve primarily to block the gap beyond the primary opening and guide the length of hair towards the primary opening. However, in the embodiments shown the guide parts also serve the secondary function of pressing the length of hair towards the primary opening. In particular, the movable guide part 254 etc. serves to press the length of hair below the leading edge 228 of the rotatable element 234, so as to reduce the likelihood that some of the length of hair is not captured by the rotatable element.

In the embodiment of FIGS. 6-11, the guide part 254 is generally in the form of a U-shaped element which is pivotably mounted upon the body 212. The base of the U-shaped element is located within a pocket 270 (FIG. 10) of a movable panel 256, the movable panel being pivotably mounted upon the handle 214. The guide part 254 is therefore mounted to move with the movable panel 256, but some relative movement must be accommodated because of the differing pivot positions.

The movable panel 256 is resiliently biased to its open position (FIGS. 6 and 8), and the user moves the panel 256 to its closed position by pressing a pivoting trigger 260 towards the handle 214.

In the drawings the handle 214 and the trigger 260 are curved, but they could be linear as in other embodiments.

As in the embodiment of FIGS. 1-5, the movable panel 256 serves both to cover the rotatable element 234 in use, and also carries a heating element (not shown) to heat the chamber 216.

Figure 14:
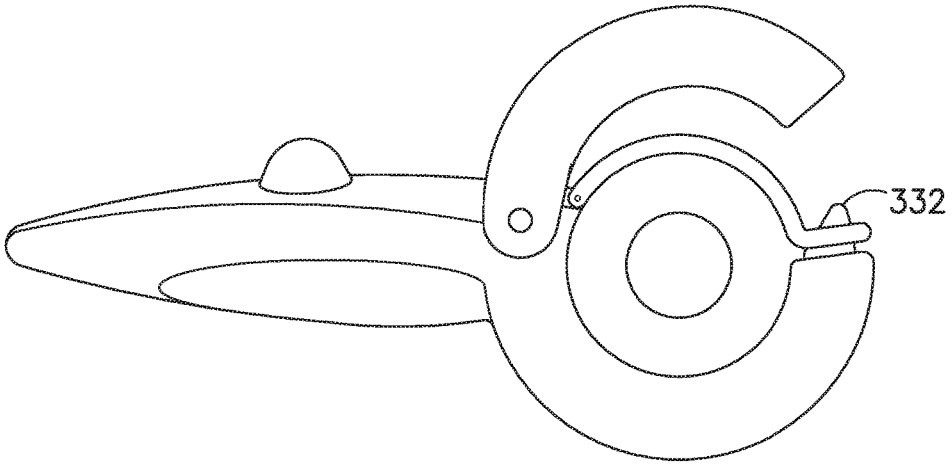
FIG. 14 shows a side view as FIG. 13 with the guide part in the closed position.
Figure 15:
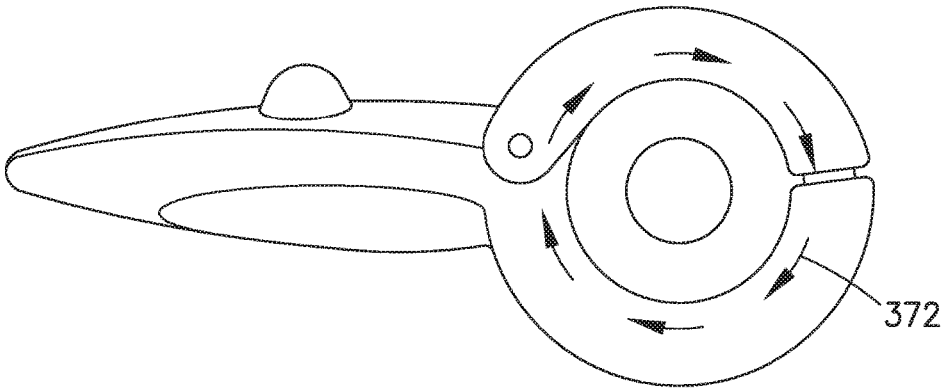
FIG. 15 shows a side view of the embodiment of FIG. 12 with the guide part and movable panel in the closed position.

In the embodiment of FIGS. 12-15, the guide part 354 is separate from the movable panel 356, the guide part 354 being moved to its closed or operational position as shown in FIG. 14 prior to the panel 356 being moved to its closed position as shown in FIG. 15. The step of the guide part 354 pressing the length of hair towards the primary opening 324 is therefore separate from the step of covering the rotatable element 334.

In FIG. 15 the arrows show the circular path 372 of the leading edge 328 of the rotatable element. It will be apparent from FIGS. 14 and 15 that it is arranged that when the guide part 354 is in its closed position it lies close to the primary opening 324, and importantly within the circular path 372. The guide part 354 (and similarly the guide parts of the other embodiments) acts firstly to guide the length of hair towards the primary opening, and secondly to press the length of hair below the circular path taken by the leading edge 328 of the rotatable element 334 so as to ensure that all of the length of hair is captured by the rotatable element.

Also in common with the other embodiments, the movable panel 356 covers and encloses the rotatable element 334 so as to prevent stray hair being engaged by the rotatable element. It is therefore desirably arranged that, in common with other embodiments, the rotatable element 334 cannot be rotated until the guide part 354 and the movable panel 356 are in their operative or closed positions shown in FIG. 15.

Figure 8:
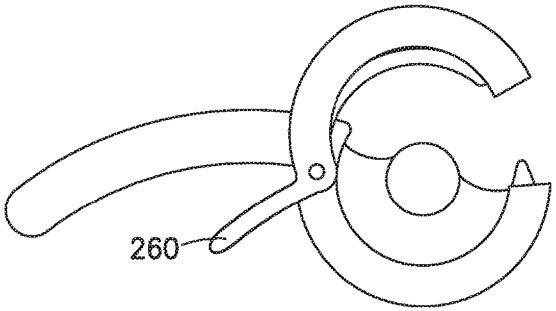
FIG. 8 shows a side view as FIG. 6.
Figure 10:
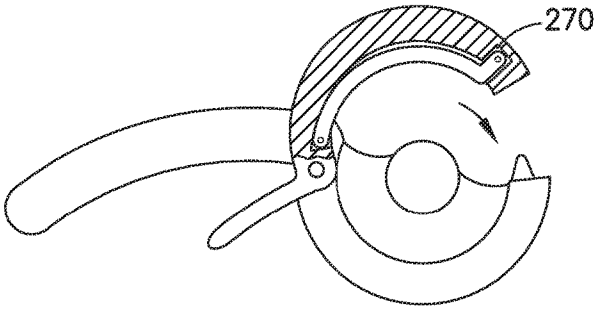
FIG. 10 shows a sectional view of part of the device of FIG. 6, in the open position.
Figure 12:
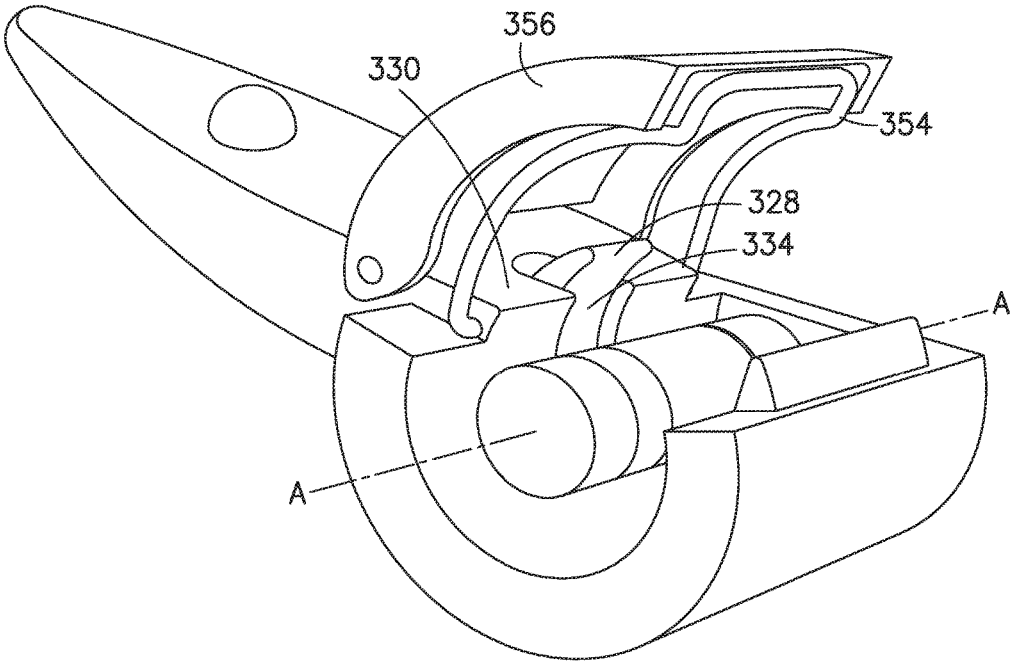
FIG. 12 shows a perspective view of an alternative embodiment of hair styling device according to the second aspect, with the guide part and movable panel in the open position.
Figure 13:
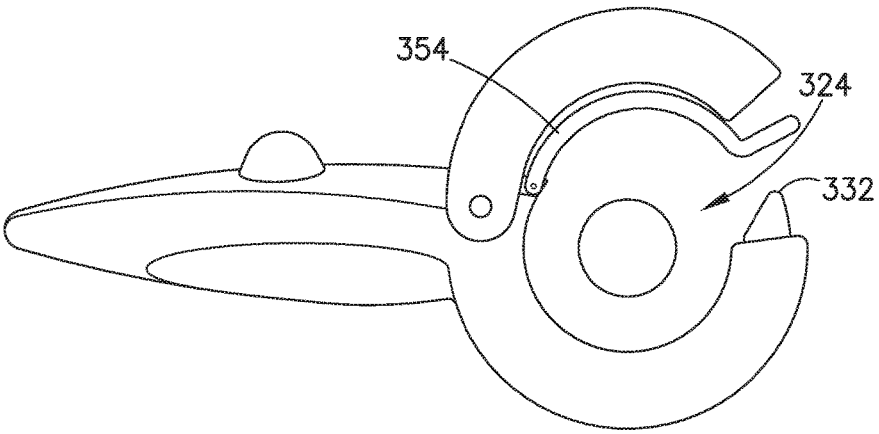
FIG. 13 shows a side view of the embodiment of FIG. 12 with the guide part and movable panel in a different position.

The primary function of the guide parts 254, 354 (etc.) is most apparent from FIGS. 8 and 12 (and also FIG. 54), namely blocking the gap between the body and the movable panel beyond the primary opening and thereby guiding the length of hair towards the primary opening 224, 324. It will be apparent that when a length of hair is pushed into the gap between the body 212, 312 and the movable panel 256, 356 respectively, it engages the respective guide part 254, 354 so that the guide part prevents any hair being pushed into an area beyond the primary opening where it might become trapped between the body and the movable panel as the movable panel is closed. The angled orientation of the guide part 254, 354 above the primary opening causes the length of hair to be positively guided towards the primary opening. It will be understood that the angled arrangement of the guide part is preferable but not essential; provided the guide part blocks the gap beyond the primary opening it can be used to guide the length of hair towards the primary opening.

In common with the rear inclined surface disclosed in WO2012/080751, it is an important function of the guide part 254, 354 etc. to reduce the likelihood that any part of the length of hair is inadvertently pushed beyond the primary opening where it may potentially become trapped between the body and the movable panel. In WO2012/080751 this is achieved by making the range of movement of the movable panel smaller than is necessary for the movable panel to clear the top of the inclined surface (or alternatively stated by making the inclined surface large enough to lie within the movable panel when the movable panel is fully opened). Effectively therefore the rear inclined surface of WO2012/

080751 blocks the gap which exists between the body and the movable panel beyond the primary opening, and thereby prevents hair being inadvertently pushed beyond the primary opening. The advantage of a movable guide part is that the movable guide part can be used to block the gap beyond the primary opening and it is not necessary to provide a fixed surface to block the gap. The movable panel may therefore be moved beyond the height of the fixed inclined surface, thereby increasing the size of the gap into which the length of hair may be introduced (this feature is most clearly shown in the embodiment of FIG. 54). Alternatively or additionally, the inclined surface may be made smaller without limiting the range of movement of the movable panel. Since the movable panel must accommodate the inclined surface in its closed position, a smaller inclined surface facilitates a smaller (and in particular a thinner) movable panel and thereby a smaller hair styling device.

The blocking and guiding functions of the guide part are enhanced because the pivot axis of the guide part 254, 354 (etc.) is located close to (and in particular immediately adjacent to) the primary opening.

In the embodiment of FIGS. 12-15 the body 312 has an inclined surface 330 upon which the guide part 354 is mounted. Depending upon the mounting location of the guide part, the inclined surface can cooperate with the guide part in physically preventing any of the length of hair being inadvertently pushed by the user beyond the primary opening. It is apparent from FIG. 10 that in this embodiment the guide part is mounted so close to the primary opening that only a small part of the inclined surface can be engaged by the length of hair. The inclined surface can therefore be very small, as can the recess within the movable panel 256 which is provided to accommodate the inclined surface.

The embodiment of FIGS. 12-15 includes another fixed inclined surface 332 which serves to guide the length of hair towards the primary opening 324. The sides of the guide part 354 are spaced apart along the longitudinal axis A-A by a distance only slightly greater than the width of the inclined surface 332, so that in the closed position the guide part closely surrounds the inclined surface 332.

It will therefore be understood that any of the length of hair lying adjacent to the inclined surface 332 when the guide part 354 and panel 356 are in their open position (FIG. 12), will be pressed by the guide part 354 along the inclined surface 332 towards the primary opening 324 as the guide part 354 is moved to its closed position. The length of hair will therefore be held adjacent to the primary opening 324 as the rotatable element begins to rotate, whereby the likelihood of any portion of the length of hair not being captured by the rotatable element 334 is much reduced or eliminated.

Figure 18:
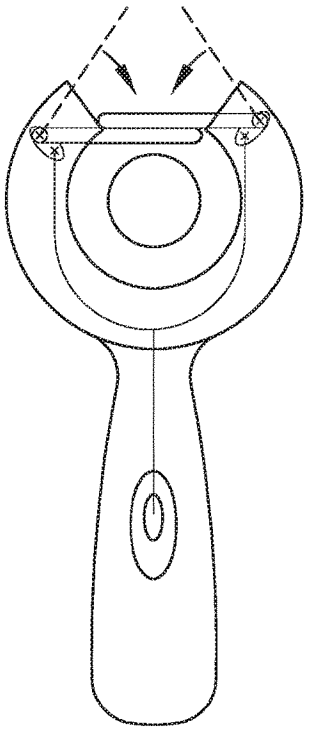
FIG. 18 shows a side view of the embodiment of FIG. 16 with the guide parts in the closed position.
Figure 17:
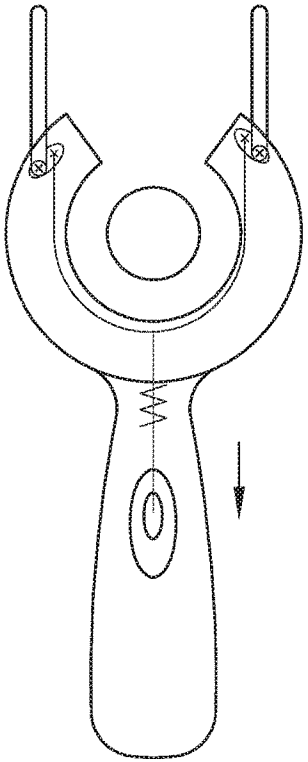
FIG. 17 shows a side view of the embodiment of FIG. 16 with the guide parts in a different position.
Figure 16:
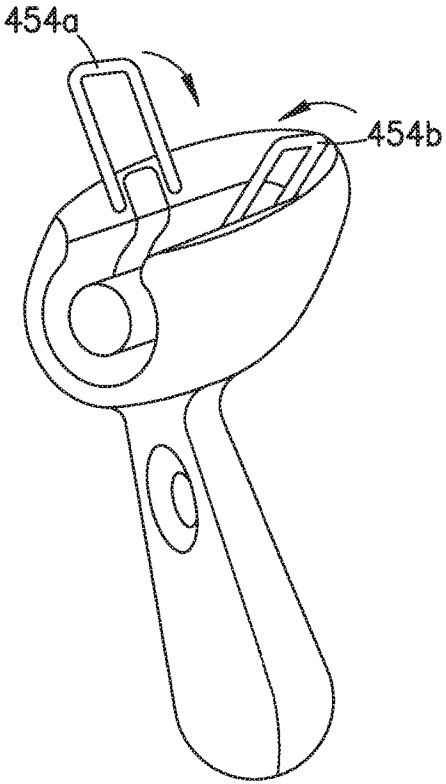
FIG. 16 shows a perspective view of another alternative embodiment of hair styling device according to the second aspect, with the guide parts in the open position.

The alternative embodiment of FIGS. 16-18 has two guide parts 454*a* and 454*b* which can move from their open position shown in FIG. 16, through their intermediate position of FIG. 17, to their closed position of FIG. 18, during which movement the guide parts engage the length of hair and press it towards the primary opening.

Once again, the guide parts 454*a,b* are U-shaped, and it will be understood that the base of each U-shaped guide part must lie outside the circular path of the leading edge of the rotatable element (so that they do not foul the rotatable element), whilst the sides of the guide parts lie within the circular path.

The guide parts 454*a,b* are electrically actuated in this embodiment, but could be made mechanically actuated if desired.

Figure 20:
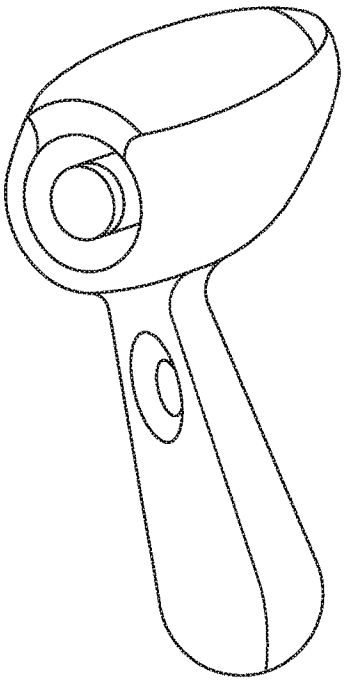
FIG. 20 shows a view as FIG. 19 but with the guide part and movable panel in the closed position.
Figure 19:
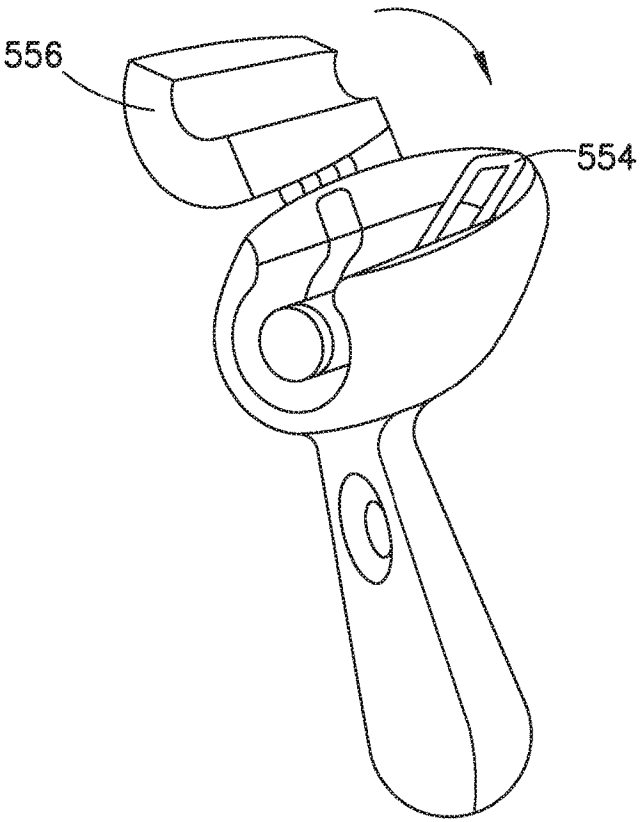
FIG. 19 shows a perspective view of yet another alternative embodiment of hair styling device according to the second aspect, with the guide part and movable panel in the open position.
Figure 21:
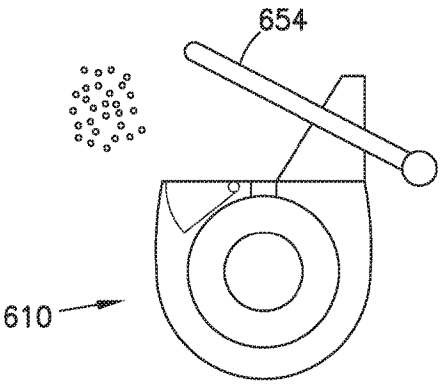
FIG. 21 shows a side view of part of a further alternative embodiment of hair styling device according to the second aspect, with the guide parts in the open position.
Figure 22:
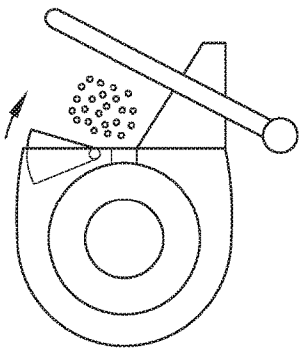
FIG. 22 shows a view as FIG. 21, following the introduction of a length of hair.
Figure 23:
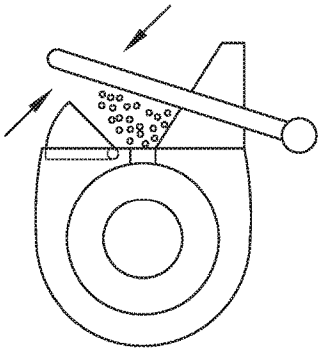
FIG. 23 shows a view as FIG. 22 as the guide parts move to the closed position.
Figure 24:
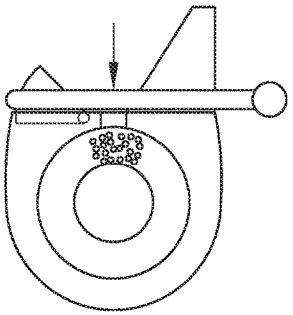
FIG. 24 shows a view as FIG. 22 with the guide parts in the closed condition.
Figure 25:
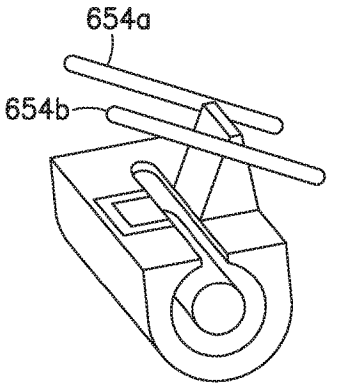
FIG. 25 shows a perspective view of the part of the embodiment of FIG. 21.
Figure 26:
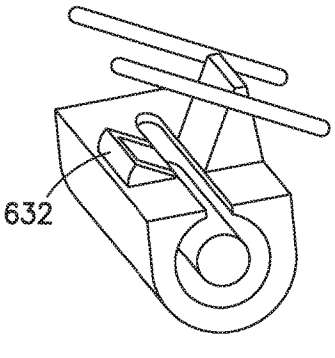
FIG. 26 shows a perspective view of the embodiment of FIG. 21, in the position of FIG. 22.
Figure 27:
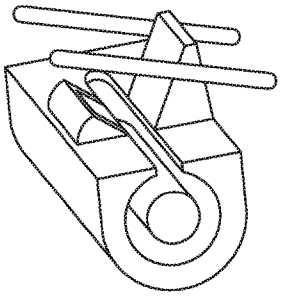
FIG. 27 shows a perspective view of the embodiment of FIG. 21, in the position of FIG. 23.
Figure 28:
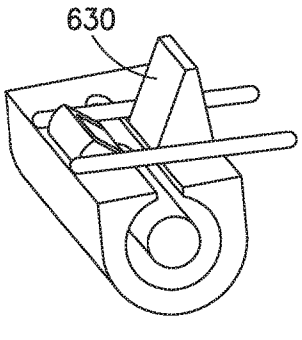
FIG. 28 shows a perspective view of the embodiment of FIG. 21, in the position of FIG. 24.

The embodiment of FIGS. 19 and 20 is somewhat similar to that of FIGS. 16-18, except that this device includes a single guide part 554 and a cooperating movable (and heated) panel 556.

The embodiment of FIGS. 21-28 has a first guide part 654 comprising two fingers 654*a*, 654*b*, which effectively comprise the sides of the U-shaped guide part of the earlier embodiments, without the base. This embodiment also has one fixed inclined surface 630 and a second guide part in the form of a movable inclined surface 632.

FIGS. 21-24 show side views of the sequence of operations of the device 610, and FIGS. 25-28 show the sequence in perspective view. It will be observed that the inclined surface 632 moves from its open or retracted position of FIGS. 21 and 25, to its closed or extended position of FIGS. 24 and 28, as the guide parts 654*a,b* are moved to their closed positions.

Figure 30:
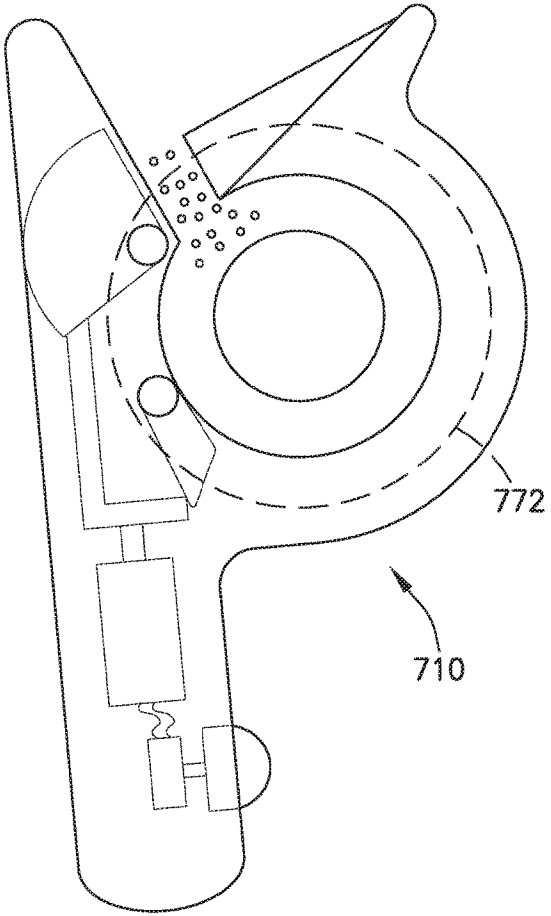
FIG. 30 shows a side view of the embodiment of FIG. 29 with the guide part in the open position.
Figure 31:
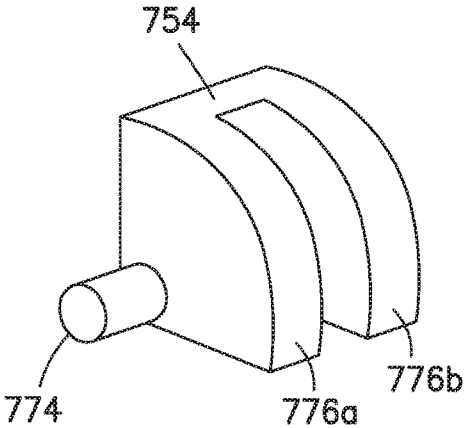
FIG. 31 shows the guide part of the embodiment of FIG. 29.

FIGS. 29-33 show views of an embodiment using a different form of guide part 754. In this embodiment the guiding function of the guide part 754 is less significant than its pressing function. The guide part 754 is shown in FIG. 31, and comprises a bifurcated member which can pivot about an axle 774. The rotatable element 734 (the circular path 772 of the leading edge of which is shown in dotted outline in FIGS. 29 and 30) can pass between the two side parts 776*a* and 776*b* of the guide part 754.

Figure 29:
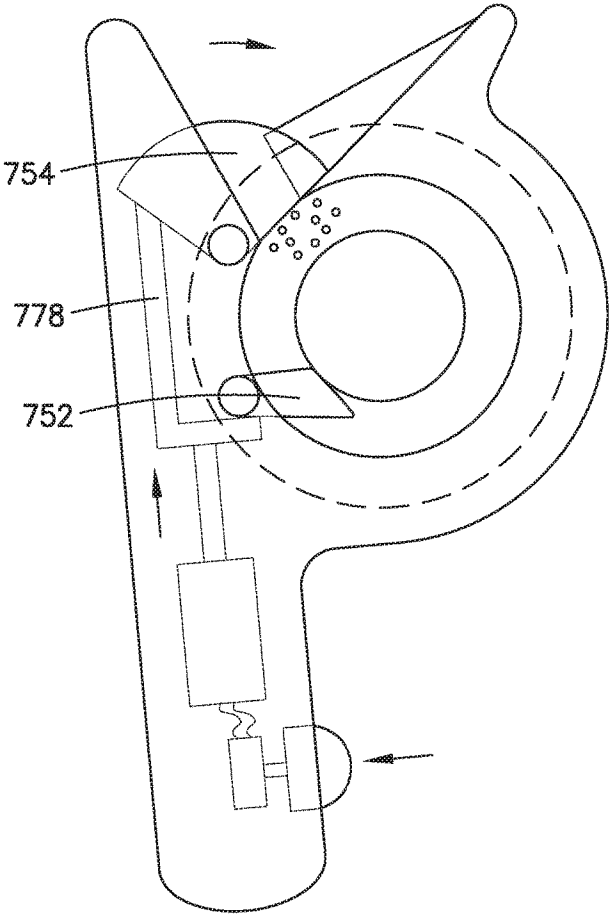
FIG. 29 shows a side view of a yet further alternative embodiment of hair styling device according to the second aspect, with the guide part in the closed position.
Figure 33:
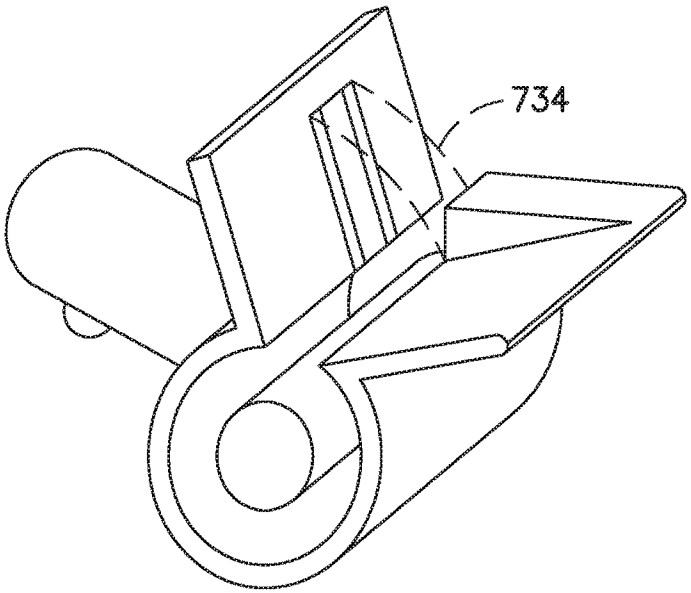
FIG. 33 shows a perspective view of the embodiment of FIG. 29.
Figure 32:
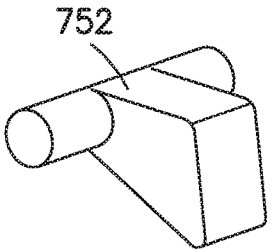
FIG. 32 shows the movable abutment of the embodiment of FIG. 29.

The device 710 is electrically actuated, and includes a drive member 778 which can move between a retracted position shown in FIG. 30 and an extended position shown in FIG. 29. In the retracted position the guide part 754 is resiliently biased to its open position and in the extended position the drive member 778 drives the guide part 754 to its closed position.

The device 710 also includes a movable abutment 752 which is similarly pivoted between its open and closed positions by the drive member 778.

It will be understood that the guide part of certain embodiments is generally interchangeable with the guide part of other embodiments, and similarly for the means of moving the guide part. It will also be understood that the guide part provides its guiding function primarily during the initial stage of operation in which the length of hair is introduced into the device by the user (during which stage the guide part is substantially stationary). The guide part provides its pressing function in the subsequent stage of operation during which the guide part moves towards the primary opening.

Figures 34, 35, 36:
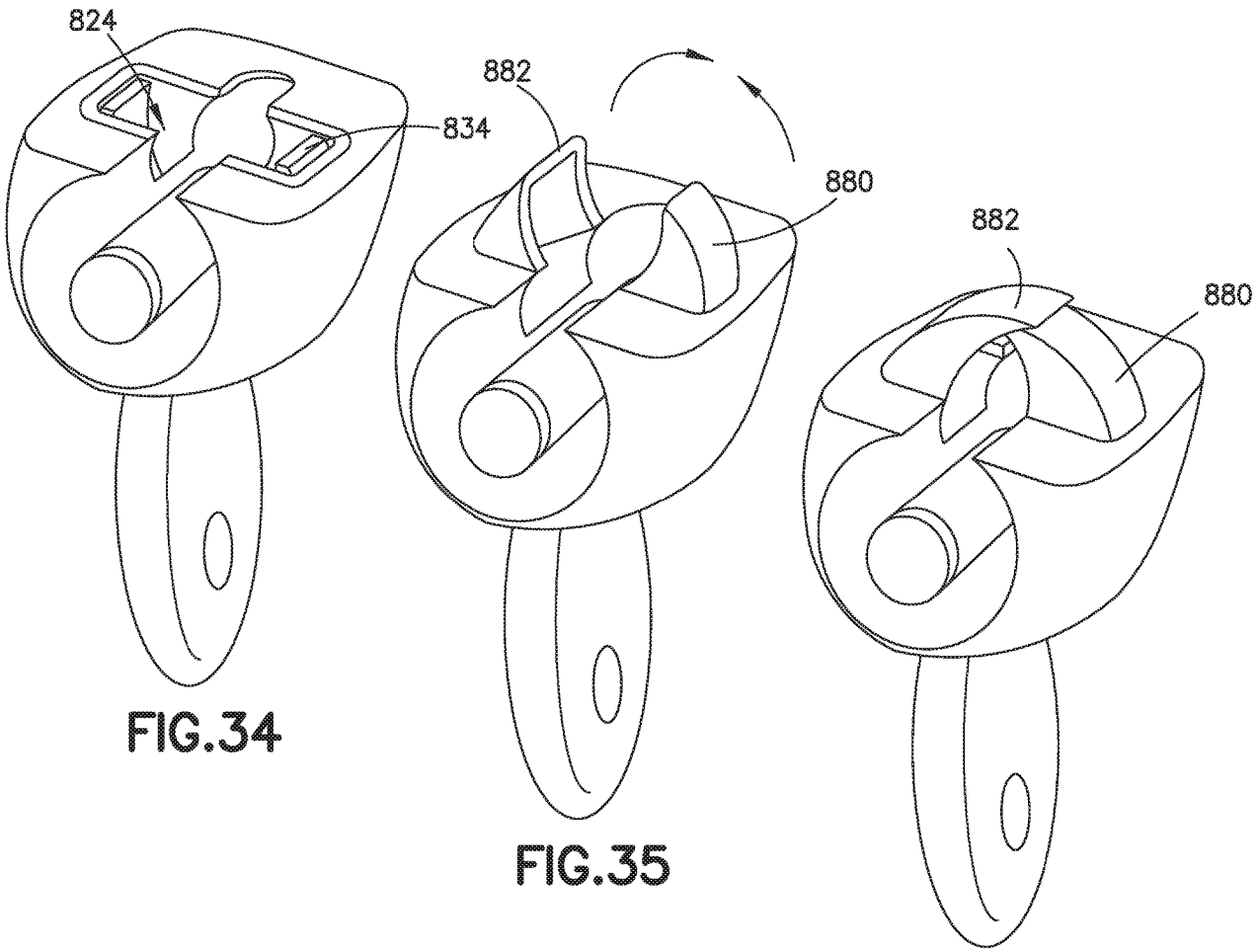
FIG. 34 shows a perspective view of an embodiment of hair styling device according to the third aspect, with the cover elements in their open position.
FIG. 35 shows a view as FIG. 34 but with the cover elements partially closed.
FIG. 36 shows a view as FIG. 34 but with the cover elements in the closed position.

The embodiment of FIGS. 34-36 has two movable cover elements 880, 882 for the rotatable element 834. The movable cover elements 880, 882 can move between an open position as shown in FIG. 34, through an intermediate position shown in FIG. 35, to a closed position as shown in FIG. 36. It will be observed that in the open position the rotatable element 834 is exposed, whereas in the closed position the rotatable element 834 is covered by the movable cover elements 880, 882. The cover element 880 is smaller than the cover element 882, and in the closed position the cover element 882 overlies (and covers) a part of the cover element 880.

In addition, as seen in FIG. 35, the movable cover elements 880, 882 have respective leading edges which act to press a length of hair towards the primary opening 824 as they move to their closed position. The movable cover elements in this embodiment therefore act both as pressing parts to urge the length of hair towards the primary opening and as a cover for the rotatable element. In an alternative embodiment in which the cover elements move only between the positions show in FIGS. 35 and 36 they can provide an initial guiding function also.

In each of the embodiments of FIGS. 1-36 the pivot axis of the movable panel and/or the pivot axis of the pressing part(s) is parallel (or substantially parallel) to the longitudinal axis A-A of the elongate member. In other embodiments the pivot axis of the movable panel, and/or the pivot axis of the pressing part(s) is at an angle to the elongate member.

In the preferred embodiments in which the rotatable element is a substantially planar disc, it is desirable that the rotatable element rotate about an axis which is substantially parallel to the longitudinal axis of the elongate member A-A. Arranging the pivot axis of the pressing part to be substantially parallel to the longitudinal axis A-A, and therefore substantially parallel to the axis of rotation of the rotatable element, results in the pressing part moving about an axis which is substantially perpendicular to the plane of the disc, whereby the pressing part can move along a path close to, but not engaging, the rotatable element.

Figure 38:
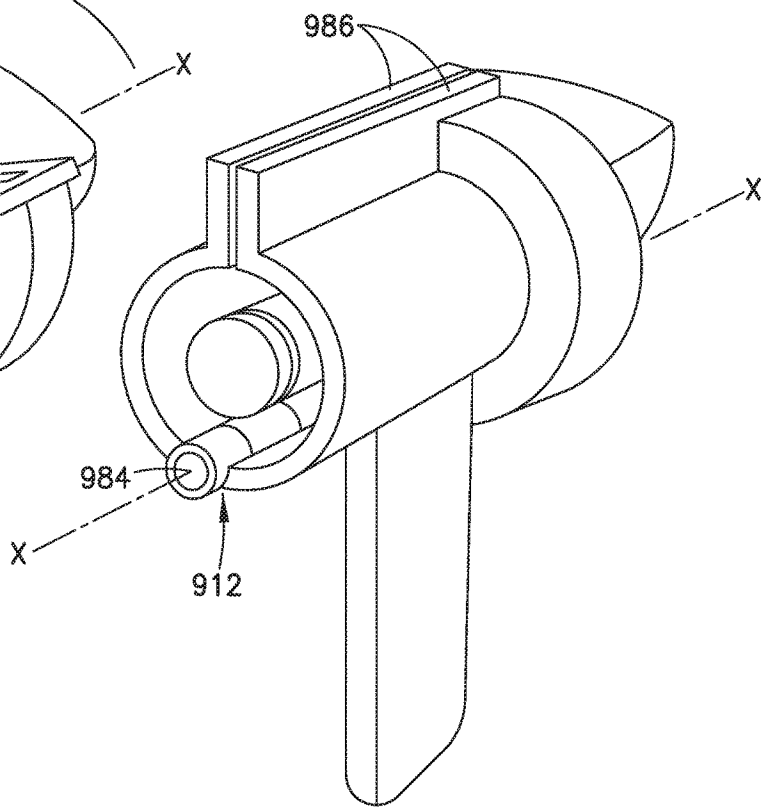
FIG. 38 shows a view as FIG. 38 but with the body parts in the closed position.
Figure 37:
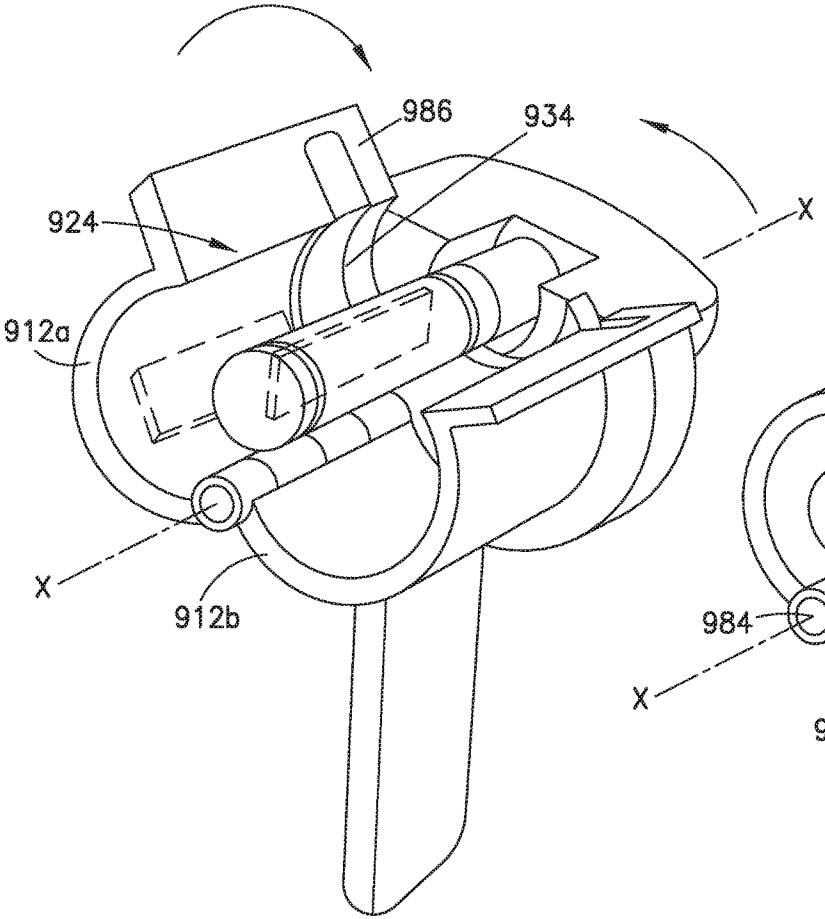
FIG. 37 shows a side view of an embodiment of hair styling device according to the fourth aspect, with the body parts in the open position.

In the embodiment of FIGS. 37 and 38 the body 912 is formed from two body parts 912*a*, 912*b* which are hinged to one another by way of a hinge 984.

Each of the body parts 912*a,b* has a respective flange 986 which in the open position of FIG. 37 are inclined and serve to guide a length of hair towards the primary opening 924. In the closed position of FIG. 38 the flanges 986 engage one another so that the primary opening is fully closed before the rotatable element 934 begins to rotate.

Each of the body parts 912*a,b* has a groove 986 which accommodates the rotatable element 934. Each of the body parts 912*a,b* can carry a respective heating element if desired.

The body parts 912*a,b* are substantially mirror-images of one another in this embodiment, but it will be understood that mirror-image body parts are not required to form a body such as 912.

FIGS. 37 and 38 show the preferred embodiment in which the axis of the hinge 984 is parallel (or substantially parallel) to the longitudinal axis A-A of the elongate member, but in other embodiments the hinge axis is arranged at an angle to the longitudinal axis of the elongate member.

Figure 39:
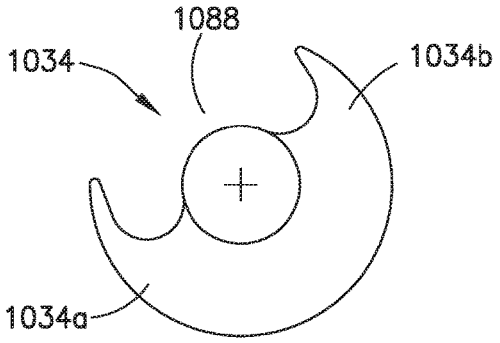
FIG. 39 shows a side view of an embodiment of hair styling device according to the fifth aspect, with the first and second parts of the rotatable element in their open position.
Figure 40:
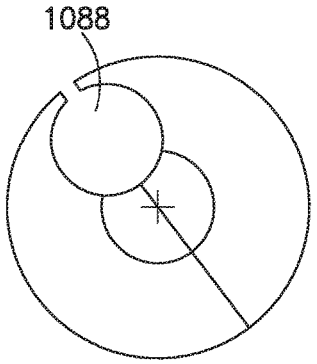
FIG. 40 shows a view as FIG. 39, but with the first and second parts in their closed position.
Figure 41:
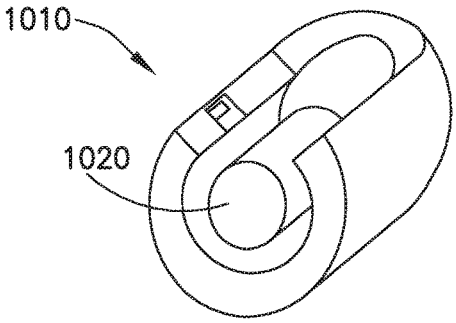
FIG. 41 shows a part of an embodiment of hair styling device according to the fifth aspect, with the first and second parts of the rotatable element in their open position.

The embodiment of FIGS. 39-43 has a two-part rotatable element 1034, comprising a first part 1034*a* and a second part 1034*b*. Prior to operation of the device 1010 the first part 1034*a* and the second part 1034*b* adopt an open position as shown in FIGS. 39 and 41. In that condition the rotatable element 1034 provides an open-ended aperture 1088 into which a length of hair can be inserted by the user (and/or pressed by the pressing part of the device if present).

Figure 42:
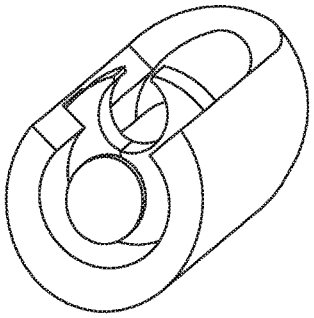
FIG. 42 shows a view as FIG. 41, but with the first and second parts of the rotatable element in a partially closed position.
Figure 43:
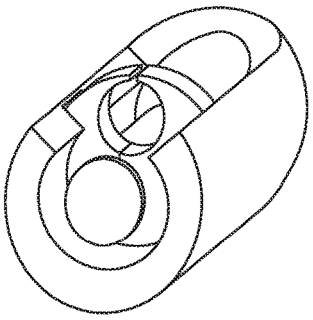
FIG. 43 shows a view as FIG. 41, but with the first and second parts of the rotatable element in the closed position.
Figure 44:
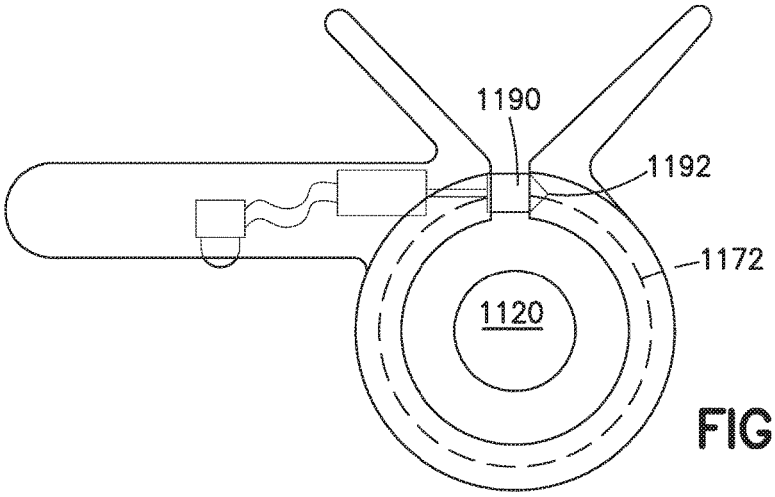
FIG. 44 shows a side view of an embodiment of hair styling device according to the sixth aspect, with the closure element in an operative position.
Figure 45:
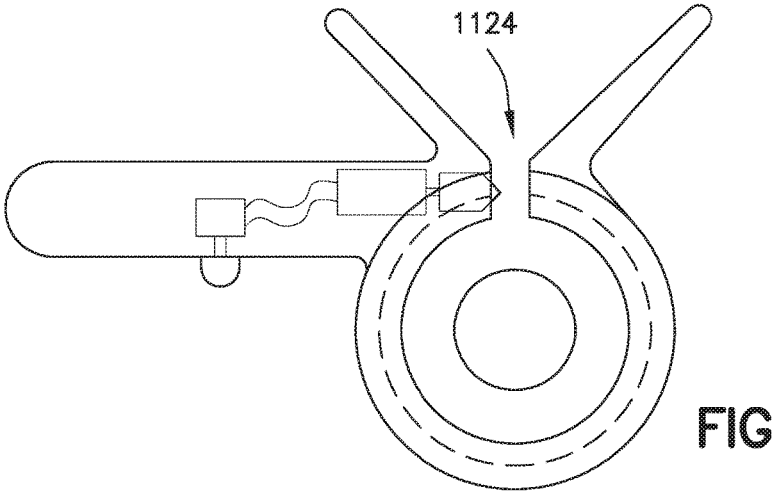
FIG. 45 shows a view as FIG. 44, but with the closure element in an inoperative position.
Figure 46:
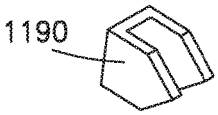
FIG. 46 shows the closure element of FIG. 44.

When the length of hair has been placed or pressed into the open-ended aperture 1088, the parts 1034*a,b* contra-rotate, and move through the intermediate position of FIG. 42 to the closed position of FIGS. 40 and 43. In the closed position the aperture 1088 is fully or substantially closed. Any hair located therein is retained within the aperture 1088 and stray hair cannot enter the aperture. The rotatable element 1034 is then rotated (either clockwise or anti-clockwise as desired), with the parts 1034*a,b* rotating together to maintain the closed aperture 1088.

Since the closed aperture 1088 prevents the rotatable element 1034 from capturing stray hair the likelihood of entanglement is reduced or avoided, and this embodiment may therefore be used without a cover or panel for the rotatable element. However, a cover may nevertheless be desired by certain users.

It will be understood that contra-rotation of the parts 1034*a* and *b* is not required to close the aperture 1088, and only one of the parts 1034*a,b* need be rotated to close the aperture. Once the aperture 1088 is closed the parts 1034*a,b* rotate together to curl the length of hair around the elongate member 1020.

FIGS. 44-48 show an embodiment utilising a closure element according to the sixth aspect of the invention. According to this aspect, a pressing part to press the length of hair towards the primary opening 1124 is not provided. Instead, the closure element 1190 is provided coincident with the circular path 1172 of the leading edges 1128 of the rotatable element 1134. By arranging the closure element 1190 at this location, and providing a tapered leading end 1192, the closure element 1190 can move hair both towards and away from the elongate member 1120, as required. Specifically, hair which is located within the circular path 1172 of the leading edge 1128 of the rotatable element 1134 is driven towards the elongate member 1120 (i.e. towards or further into the primary opening 1124), whereas hair which is located outside the circular path 1172 is pushed away from the elongate member 1120. In this way, the length of hair is divided into a first portion which will be captured by the rotatable element 1134 and a second portion which will not be captured. The first portion is pushed into the chamber 1116 as the rotatable element rotates. The second portion is held away from the rotatable element by the closure element 1190 for the duration of the styling operation.

It will be observed that the rotatable element 1134 has two leading edges 1128, and this is common to all of the embodiments described. The rotatable element can therefore capture the length of hair whether it is rotated clockwise or anti-clockwise.

FIGS. 49-51 show optional "doors" 1292 to span the primary opening 1224. In FIG. 49 the length of hair 1226 is located adjacent to the doors, which in this embodiment are flexible and resilient. The length of hair 1226 may therefore be pressed through the doors 1292 and into the chamber 1216 as shown in FIG. 50. Alternatively, the doors may be inflexible, but resiliently mounted to pivot between their open and closed positions. It can if desired be arranged that the doors retain the length of hair within the chamber 1216, i.e. they allow hair to pass into the chamber 1216 but not out of the chamber.

In the embodiments of FIGS. 6-36 the guide part performs the function of pressing the length of hair towards the primary opening. In the alternative embodiment of FIGS. 54-59 there is a separate pressing part 1394 in addition to the guide parts 1354. The pressing part 1394 is carried by the movable panel 1356 and this arrangement is particularly beneficial because the path of movement of the pressing part 1394 is almost directly towards the primary opening.

Thus, it will be understood that the movable panel 1356 pivots relative to the body about a pivot axis located at the opposite end of the handle 1314 to the body 1312. The guide parts 1354 also pivot relative to the body 1312, the pivot axis P-P (FIG. 55) of the guide parts 1354 being almost immediately adjacent to the primary opening 1324. The pressing part 1394 therefore moves through a much smaller angle than the guide parts 1354 during the closing movement of the movable panel 1356. This minimises any tendency to push the length of hair away from the primary opening.

It will be understood from the sequence of operations shown in FIGS. 56-59 that during the initial closing movement of the movable panel 1356 the length of hair will likely be engaged by the guide parts 1354 and pressed towards the primary opening. By the time the movable panel 1356 has moved to the position of FIG. 58, however, the length of hair is being pressed towards the primary opening substantially entirely by the pressing part 1394.

Figure 54:
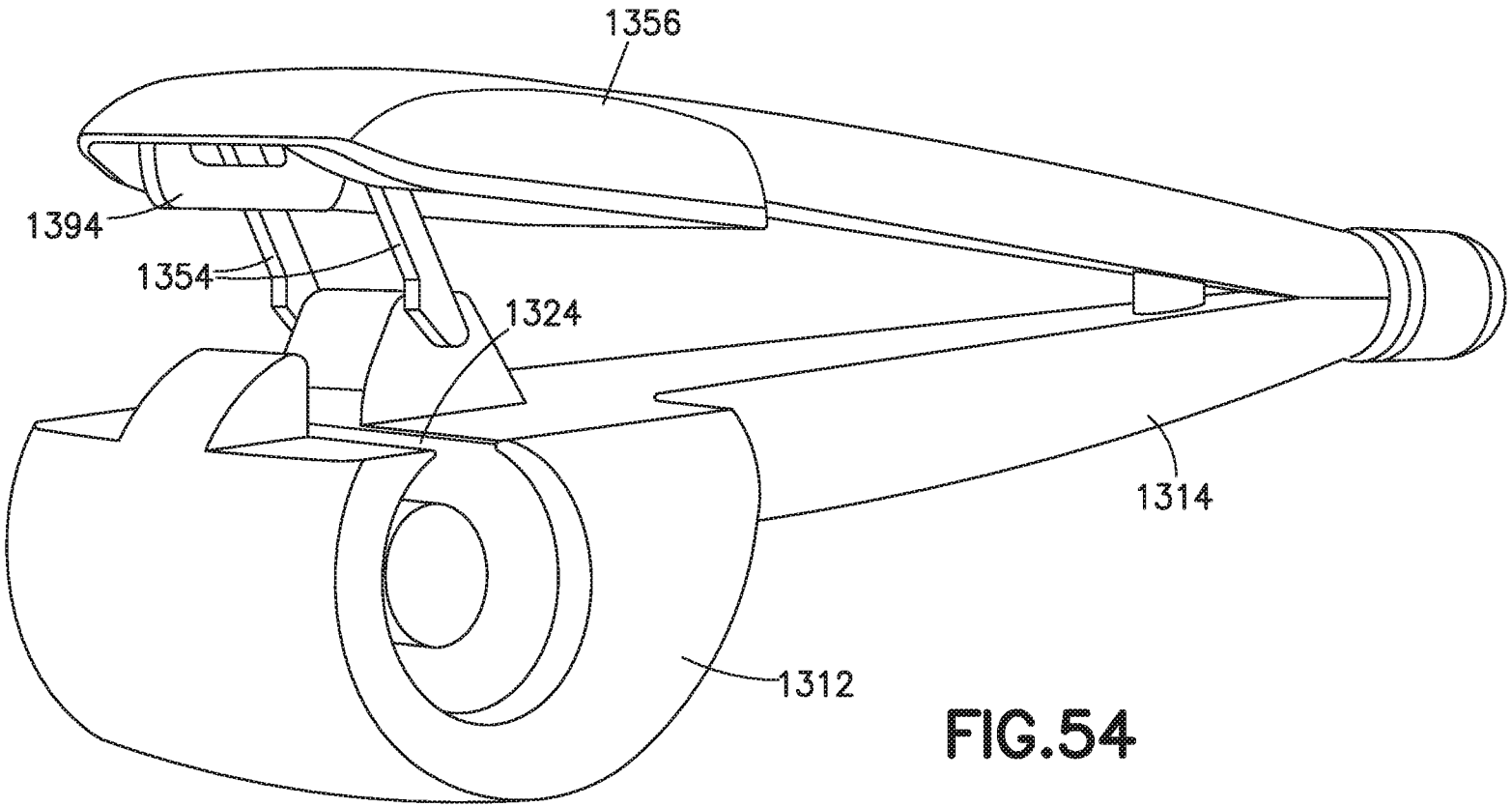
FIG. 54 shows a perspective view of another embodiment according to the second aspect.
Figure 55:
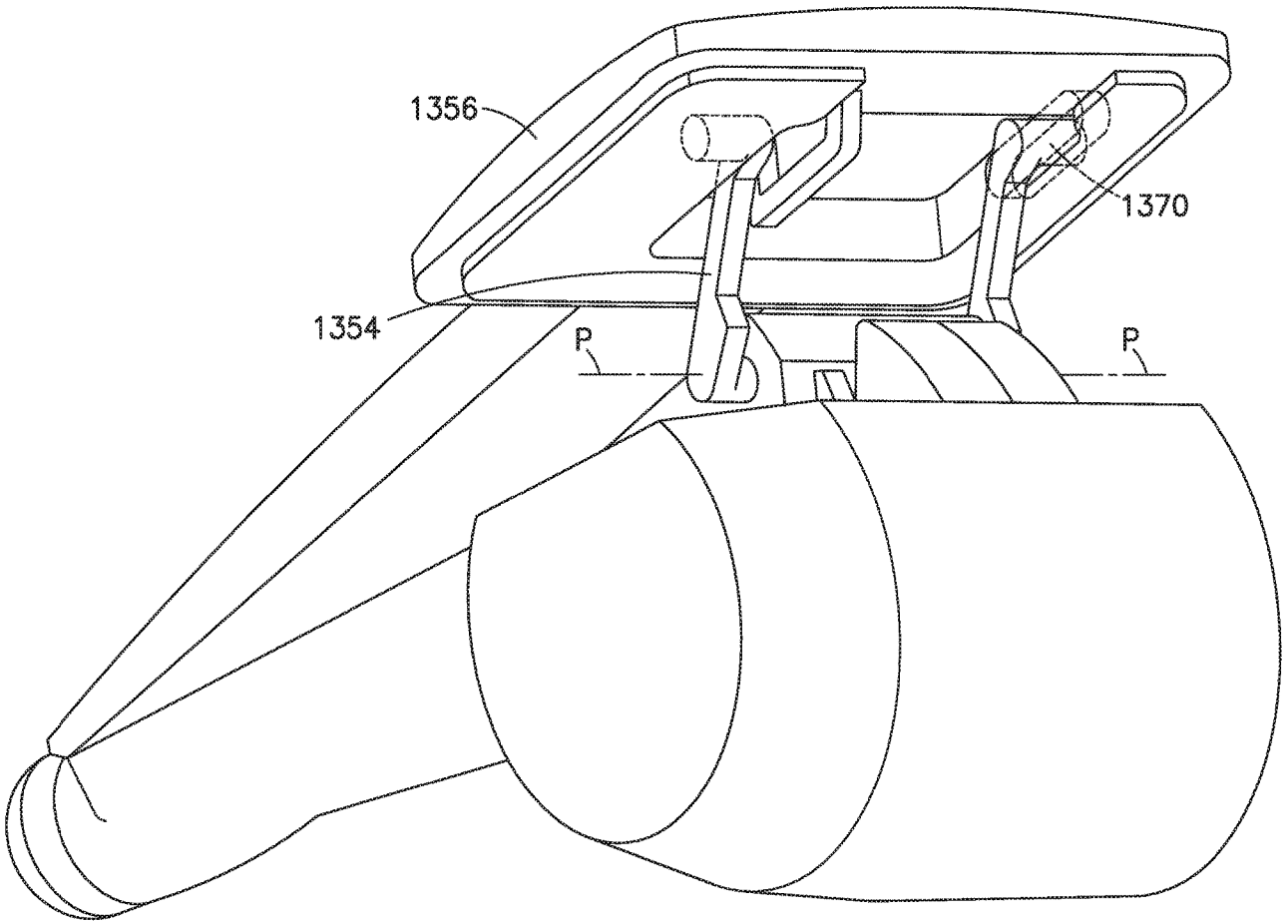
FIG. 55 shows another perspective view of the embodiment of FIG. 54.

FIG. 55 shows the underside of the movable panel 1356, and in particular the connection between the guide parts 1354 and the movable panel. In this embodiment both guide parts 1354 are formed as parts of an integral construction in a general U-shape, with the base of the U lying along the pivot axis P-P. The end of one guide part 1354 is located in a pocket or channel 1370 in the movable panel 1356, so that the guide parts 1354 are lifted up and pressed down by movement of the movable panel 1356. In another embodiment the guide parts 1354 are resiliently biased towards the position of FIGS. 54-56, and in yet other embodiments they also act to drive the movable panel 1356 to the open position.

Figure 56:
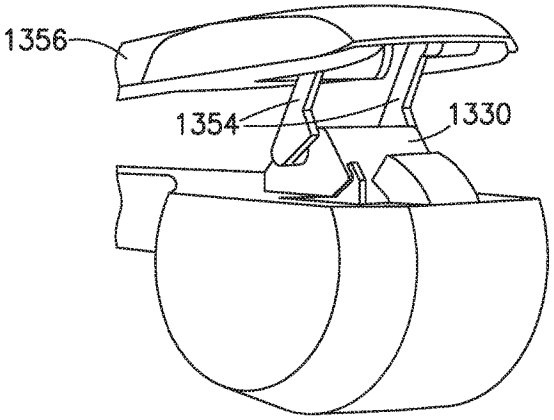
FIG. 56 shows a perspective view of part of the embodiment of FIGS. 54 and 55, with the guide part and movable panel in the open position.
Figure 57:
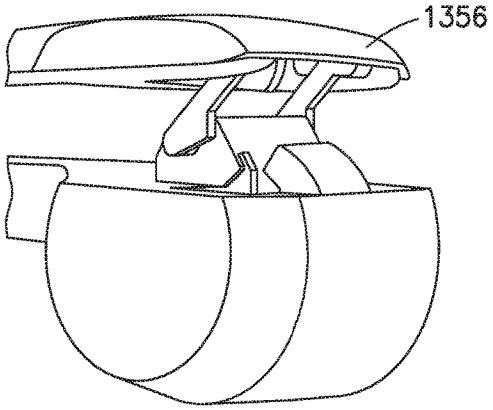
FIG. 57 shows a view as FIG. 56 with the guide part and movable panel in a first partially closed position.
Figure 58:
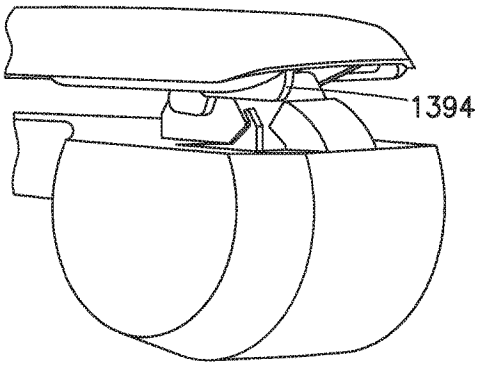
FIG. 58 shows a view as FIG. 56 with the guide part and movable panel in a second partially closed position.
Figure 59:
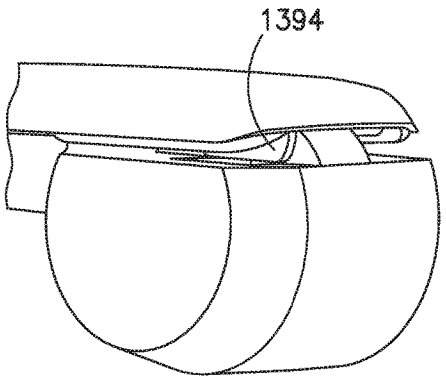
FIG. 59 shows a view as FIG. 56 with the guide part and movable panel in the closed position.

FIGS. 54 and 56 in particular show that the movable panel 1356 can be opened well beyond the height of the inclined surface 1330, so that the thickness of the movable panel 1356 (i.e. the dimension in the vertical direction as drawn) can be much reduced over the embodiment of WO2012/080751 which utilises fixed guide parts.

It will be understood that in other embodiments the guide part(s) can be movable without pivoting, i.e. the guide part(s) may be adapted to slide within a channel, or be made sufficiently flexible to move by bending, for example. In addition, in embodiments similar to that of FIGS. 21-28 the second guide part (i.e. the inclined surface ahead of the primary opening) could be made flexible to move by bending. The flexible guide part(s) are preferably deformed as they are engaged by the movable panel.

In a modification of the embodiment of FIGS. 1-5, the device could be adapted to dispense a hair treatment product onto the length of hair. The dispensing of a hair treatment product, for example a heat protective product, is discussed in WO2009/077747. In the present invention, the product could be dispensed from the movable panel 156. In a particularly advantageous embodiment, the hair treatment product could be held within a tank within the movable panel 156, the tank being sufficiently close to the heater 158 so that the treatment product is heated (and ideally vaporised) within the tank before passing out of the movable panel and engaging the length of hair.

The hair treatment product could be dispensed directly into the chamber surrounding the elongate member, or it could if desired be arranged that the treatment product engages the hair before it enters the chamber, so that the hair is pre-heated before entering the chamber. The length of hair would then likely need to remain within the chamber for a shorter period of time than would otherwise be necessary whilst the curl is set. If desired, a heater (in addition to the heater 158) could be provided to heat the length of hair before it enters the chamber, so that the (vaporised) treatment product and the additional heater act together to pre-heat the hair before it enters the chamber where the curl is set.

In common with the device disclosed in WO2009/077747, the rotatable element may be connected to a cylindrical hub which rotates with the rotatable element. The rotatable element lies between the hub and the chamber, and a section of the length of hair will be wound around the hub during the initial rotations of the rotatable element (see for example FIG. 5B of WO2009/077747). If desired, a sleeve which does not rotate with the hub may be provided around the rotating hub so as to avoid the force which would otherwise be applied to the length of hair as the hub rotates. The sleeve could be freely mounted so that it is able to rotate in either direction, which could be advantageous in permitting forced removal of the hair if necessary. Alternatively a non-rotatable sleeve could be mounted to the body of the device, such a sleeve being readily adaptable to incorporate a heater to pre-heat the length of hair before it enters the chamber.

The invention claimed is:

1. A hair styling device having:

a body defining a chamber adapted to accommodate a length of hair, the chamber having a primary opening through which the length of hair may enter the chamber;

a rotatable element housed within the chamber and adapted to engage the length of hair adjacent to the primary opening, the rotatable element having a leading edge which in use is rotated by a motor in the body around an elongate member at least partially housed in the chamber and the rotatable element engages the length of hair to wind the length of hair around the elongate member;

a movable panel mounted to move relative to the body and relative to the primary opening between an open position in which the primary opening is open to receive the hair and a closed position in which the primary opening is covered;

a guide part located directly between the body and the movable panel, and adapted to block a part of a gap between the body and the movable panel when the movable panel is in the open position and to guide the length of hair towards the primary opening, the rotatable element being rotatable relative to the guide part, the guide part being movable relative to the body and being movable relative to the movable panel.

2. The hair styling device according to claim 1 in which the guide part is adapted to press the length of hair towards the primary opening in use.

3. The hair styling device according to claim 1 in which the movable panel covers the rotatable element in the closed position.

4. The hair styling device according to claim 1 in which the movable panel covers the guide part in the closed position.

5. The hair styling device according to claim 1 in which a first end of the guide part is mounted to the body, and in which a second end of the guide part is located within a pocket of the movable panel.

6. The hair styling device according to claim 1 in which the guide part moves relative to the body independently of the movable panel.

7. The hair styling device according to claim 1 having two guide parts, the guide parts being spaced apart along the primary opening.

8. The hair styling device according to claim 7 including a fixed guide surface mounted to the body adjacent to the primary opening, the respective guide parts being located to opposed sides of the fixed guide surface.

9. The hair styling device according to claim 1 in which the guide part is pivotably mounted to the body.

10. The hair styling device according to claim 9 in which the pivotable mounting of the guide part is adjacent to the primary opening.

11. The hair styling device according to claim 1 in which the elongate member has a width, and in which the primary opening is at least as wide as the width of the elongate member.

12. The hair styling device according to claim 1 in which at least a part of the elongate member lies within the primary opening.

13. The hair styling device according to claim 1 in which the elongate member terminates within the chamber.

14. The hair styling device according to claim 1 in which the rotatable element has a first part and a second part, the first part and second part being movable relative to one another, the first and second parts having an open condition in which they define an open-ended aperture adapted to capture a length of hair, and a closed position in which the aperture is substantially closed.

15. The hair styling device according to claim 3 in which the movable panel covers the guide part in the closed position.

* * * * *